US011732970B2

(12) United States Patent
Lee et al.

(10) Patent No.: US 11,732,970 B2
(45) Date of Patent: Aug. 22, 2023

(54) HEAT EXCHANGE UNIT AND METHOD OF MANUFACTURE THEREOF

(71) Applicant: National University of Singapore, Singapore (SG)

(72) Inventors: Poh Seng Lee, Singapore (SG); Nuttawut Lewpiriyawong, Uttaradit (TH); Chuan Sun, Guangdong (CN); Kent Loong Khoo, Singapore (SG)

(73) Assignee: National University of Singapore, Singapore (SG)

( * ) Notice: Subject to any disclaimer, the term of this patent is extended or adjusted under 35 U.S.C. 154(b) by 161 days.

(21) Appl. No.: 17/256,922

(22) PCT Filed: Jun. 27, 2019

(86) PCT No.: PCT/SG2019/050321
§ 371 (c)(1),
(2) Date: Dec. 29, 2020

(87) PCT Pub. No.: WO2020/005162
PCT Pub. Date: Jan. 2, 2020

(65) Prior Publication Data

US 2021/0285725 A1 Sep. 16, 2021

Related U.S. Application Data

(60) Provisional application No. 62/691,940, filed on Jun. 29, 2018.

(51) Int. Cl.
*F28D 1/053* (2006.01)
*F28F 1/02* (2006.01)
(Continued)

(52) U.S. Cl.
CPC ..... *F28D 1/05383* (2013.01); *F28F 1/022* (2013.01); *F28F 1/32* (2013.01); *F28F 9/002* (2013.01)

(58) Field of Classification Search
CPC .... F28F 1/025; F28F 1/022; F28F 1/32; F28F 9/002; F28D 1/05383
(Continued)

(56) References Cited

U.S. PATENT DOCUMENTS 1,125,027 A * 1/1915 Max-Kretchmer ..... 165/172
1,618,485 A * 2/1927 Skinner ..... F28F 1/04 165/DIG. 443
(Continued)

FOREIGN PATENT DOCUMENTS

CN 204612535 U 9/2015
GB 2565486 A 2/2019
(Continued)

OTHER PUBLICATIONS

Foreign Communication from a Related Counterpart Application, International Search Report and Written Opinion dated Sep. 23, 2019, International Application No. PCT/SG2019/050321 filed on Jun. 27, 2019.

*Primary Examiner* — Tho V Duong
*Assistant Examiner* — Raheena R Malik

(57) ABSTRACT

The present disclosure generally relates to a heat exchanger (50) and a heat exchange unit (100) for the heat exchanger (50). The heat exchange unit (100) comprises: a plurality of plain fins (102) stacked perpendicularly to a first plane, such that a first fluid (104) is communicable through the first plane between the fins (102); and a plurality of tubes (112) for communicating a second fluid (110) therethrough for heat exchange with the first fluid (104), the tubes (112) extending perpendicularly through the fins (102), each tube (112) comprising an oblique cross-section (114) having a pair of opposing first sides (114*a*) and a pair of opposing second sides (114*b*). For each oblique cross-section (114), the first sides (114*a*) are perpendicular to the first plane and
(Continued)

the second sides (114*b*) are angled approximately 60° to the first plane, the first sides (114*a*) being longer than the second sides (114*b*).

20 Claims, 20 Drawing Sheets

(51) Int. Cl.
*F28F 1/32* (2006.01)
*F28F 9/00* (2006.01)

(58) Field of Classification Search
USPC ..... 165/172
See application file for complete search history.

(56) References Cited

U.S. PATENT DOCUMENTS 4,577,684 A * 3/1986 Hagemeister ..... F28F 1/022 165/172
4,730,669 A * 3/1988 Beasley ..... F28F 9/182 165/173
4,766,953 A * 8/1988 Grieb ..... B21C 37/151 29/890.039
5,251,692 A 10/1993 Haussmann
5,967,228 A * 10/1999 Bergman ..... F28F 1/022 165/184
7,549,465 B2 * 6/2009 Gong ..... F28F 1/325 165/173
8,460,614 B2 * 6/2013 Rizzi ..... B01J 19/249 165/172
10,302,369 B1 * 5/2019 Siebert ..... F28F 1/04
2012/0031601 A1 * 2/2012 Matter, III ..... F28D 1/05383 165/177
2019/0301808 A1 * 10/2019 Holtzapple ..... B01D 1/289
2021/0003349 A1 * 1/2021 Horoszczak ..... F28F 9/02
2021/0285725 A1 * 9/2021 Lee ..... F28F 1/022

FOREIGN PATENT DOCUMENTS

JP 2008-241057 A 10/2008
JP 2009-281693 A 12/2009
WO 2018003123 A1 1/2018
WO 2020005162 A1 1/2020

* cited by examiner

600

| | |
|---|---|
| Circular tube material | Copper |
| Oblique tube material | Aluminium |
| Fin material | Aluminium |
| Fin thickness | 0.15mm |
| Fin gap | 1.228mm |
| Fin size (width x depth) | 22.1mm x 19mm |
| Number of tube row(s) | 1 |
| Longitudinal tube pitch | 22.1mm |
| Circular tube size | 6.82mm |
| Oblique tube size | 10.1mm x 4.71mm |
| Circular tube internal area | 22.1mm$^2$ |
| Oblique tube internal area | 24.6mm$^2$ |
| Fin area occupied by circular tube | 36.5mm$^2$ |
| Fin area occupied by oblique tube | 54.2mm$^2$ |
| Heat transfer area (PFCT) | 793mm$^2$ |
| Heat transfer area (PFOT) | 776mm$^2$ |
| Heat transfer area (CFCT) | 799mm$^2$ |
| Heat transfer area (CFOT) | 782mm$^2$ |

Figure 6A

| Air Velocity (m/s) | Slip Stationary Wall | | Symmetry | |
|---|---|---|---|---|
| | $Q$ (W) | $\Delta p$ (Pa) | $Q$ (W) | $\Delta p$ (Pa) |
| 1.0 | 0.266 | 4.89 | 0.266 | 4.89 |
| 1.5 | 0.330 | 8.13 | 0.330 | 8.12 |
| 2.0 | 0.377 | 11.9 | 0.377 | 12.0 |
| 2.5 | 0.416 | 16.6 | 0.416 | 16.6 |
| 3.0 | 0.450 | 21.9 | 0.450 | 21.9 |

800

| Total Element Number | $U$ (W/m$^2$K) | $\Delta p$ (Pa) |
|---|---|---|
| PFCT Model | | |
| 1,654,820 | 68.89 | 12.09 |
| 3,357,189 | 67.99 | 11.98 |
| 10,068,912 | 68.19 | 11.96 |
| PFOT Model | | |
| 1,344,056 | 88.30 | 11.70 |
| 2,948,110 | 82.97 | 10.88 |
| 9,529,168 | 83.11 | 11.07 |

1100

| Property | Copper (Cu) | Aluminium (Al) | Brass (Br) |
|---|---|---|---|
| Density (kg/m3) | 8,978 | 2,719 | 8,580 |
| Specific heat capacity (J/kgK) | 381 | 871 | 380 |
| Thermal conductivity (W/mK) | 387.6 | 202.4 | 111 |
| Yield strength (MPa) | 70 | 241 | 200 |

1110

HEAT EXCHANGE UNIT AND METHOD OF MANUFACTURE THEREOF

CROSS-REFERENCE TO RELATED APPLICATIONS

The present application is a filing under 35 U.S.C. 371 as the National Stage of International Application No. PCT/SG2019/050321, filed Jun. 27, 2019, entitled "HEAT EXCHANGE UNIT AND METHOD OF MANUFACTURE THEREOF," which claims priority to U.S. Provisional Application No. 62/691,940 filed with the United States Patent and Trademark Office on Jun. 29, 2018, both of which are incorporated herein by reference in their entirety for all purposes.

TECHNICAL FIELD

The present disclosure generally relates to heat exchangers. More particularly, the present disclosure describes various embodiments of a heat exchange unit for a heat exchanger and a method for manufacturing the heat exchange unit.

BACKGROUND

In Singapore, more than half of the electricity consumption of a typical household is from refrigeration and air conditioning (AC) usage. Household refrigeration and air conditioning appliances make use of vapour-compression refrigeration cycle to provide cooling and dehumidification for food preservation and thermal comfort of home occupants. Finned tube heat exchangers (FTHX) are commonly used in air-cooled residential AC for heat exchange between a refrigerant and air. A FTHX has a large fin area for a given volume for heat exchange between the air flow and the hot refrigerant flow in the tubes. However, one problem of the FTHX is the high thermal contact resistance between the mechanically-joined fins and tubes, which is likely due to imperfect contact at the joints, as well as oxide and dust contamination over time. Another problem is the poor heat transfer coefficient of the FTHX due to the air-side heat transfer being less efficient than the refrigerant-side one, thus limiting the heat exchange performance of the FTHX. Especially in AC systems, the air-side heat transfer is the bottleneck for air-cooled condensers to remove heat from buildings to the environment.

Circular tubes are commonly used in the FTHX and mechanical tube expansion using a mandrel is the conventional manufacturing method to join the tubes to the fins in the FTHX. Mechanical tube expansion results in air gaps and high thermal contact resistance at the joints. The thermal contact resistance is often not determined and neglected in the FTHX design due to lack of accurate measurement data and diverse joining quality, such as different tube expansion ratios. However, it has been reported that the thermal contact resistance is about 15% to 25% of the total thermal resistance for FTHX with a 7 mm tube diameter. This percentage of thermal contact resistance is not negligible and adversely affects the FTHX heat exchange performance. Moreover, air-side pressure drop is generated due to presence of wake zones behind the tubes which are caused by air flow separations over the tube surfaces. The air-side pressure drop across the circular tubes thus significantly increases the power consumption of the FTHX.

Various fin designs for FTHX have been developed to improve the heat transfer coefficient. Common fin designs for residential AC include plate fins, wavy fins, louvre fins, and compounded fins. For example, one study showed that the wavy fins and compounded fins increased the heat transfer coefficient by up to 24% and 45.5%, respectively, but the air-side pressure drop also increased by up to 31.9% and 63.1%, respectively. To reduce the pressure drop penalty while maintaining the heat transfer performance, vortex generators, such as radially positioned winglets on the fins, are implemented. Such fin designs achieved over 100% improvement in heat transfer performance but also over 140% increase in friction loss. While the heat transfer performance improved significantly, the higher friction loss is detrimental to the overall system efficiency of the FTHX.

Therefore, while current FTHX with varying fin designs and patterns may achieve higher heat transfer performance, the performance advantage is outweighed by the larger air-side pressure drop and higher friction loss, resulting in higher power consumption for the FTHX. In order to address or alleviate at least one of the aforementioned problems and/or disadvantages, there is a need to provide an improved heat exchange unit for a heat exchanger and a method for manufacturing the heat exchange unit.

SUMMARY

According to a first aspect of the present disclosure, there is a heat exchange unit for a heat exchanger. The heat exchange unit comprises: a plurality of plain fins stacked perpendicularly to a first plane, such that a first fluid is communicable through the first plane between the fins; and a plurality of tubes for communicating a second fluid therethrough for heat exchange with the first fluid, the tubes extending perpendicularly through the fins, each tube comprising an oblique cross-section having a pair of opposing first sides and a pair of opposing second sides. For each oblique cross-section, the first sides are perpendicular to the first plane and the second sides are angled approximately 60° to the first plane, the first sides being longer than the second sides.

According to a second aspect of the present disclosure, there is a method for manufacturing a heat exchange unit for a heat exchanger. The method comprises: forming a plurality of holes in each of a plurality of plain fins; stacking the fins perpendicularly to a first plane, such that a first fluid is communicable through the first plane between the fins; forming a plurality of tubes for communicating a second fluid therethrough for heat exchange with the first fluid, each tube comprising an oblique cross-section having a pair of opposing first sides and a pair of opposing second sides, the first sides being longer than the second sides; inserting the tubes into the holes and perpendicularly through the fins, such that for each oblique cross-section, the first sides are perpendicular to the first plane and the second sides are angled approximately 60° to the first plane; and performing a joining process for joining the tubes to the fins to thereby form the heat exchange unit.

According to a third aspect of the present disclosure, there is a heat exchanger comprising: an inlet for receiving a second fluid; an outlet for discharging the second fluid; and a heat exchange unit. The heat exchange unit comprises: a plurality of plain fins stacked perpendicularly to a first plane, such that a first fluid is communicable through the first plane between the fins; and a plurality of tubes fluidically communicative with the inlet and outlet for communicating the second fluid therethrough for heat exchange with the first fluid, the tubes extending perpendicularly through the fins, each tube comprising an oblique cross-section having a pair of opposing first sides and a pair of opposing second sides. For each oblique cross-section, the first sides are perpendicular to the first plane and the second sides are angled approximately 60° to the first plane, the first sides being longer than the second sides.

An advantage of one or more aspects of the present disclosure is that the plain-fin oblique-tube design is able to increase the heat transfer amount and reduce the air-side pressure drop due to the slender streamline profile of the oblique tubes. As a result, the thermal-hydraulic performance of a heat exchanger or heat exchange unit employing such plain-fin oblique-tube design can be enhanced and the power consumption can be reduced.

A heat exchanger and method for manufacturing the heat exchanger according to the present disclosure are thus disclosed herein. Various features, aspects, and advantages of the present disclosure will become more apparent from the following detailed description of the embodiments of the present disclosure, by way of non-limiting examples only, along with the accompanying drawings.

BRIEF DESCRIPTION OF THE DRAWINGS

FIGS. 6A and 6B are illustrations of dimensions and properties of some designs of the heat exchanger.

FIGS. 7A and 7B are illustrations of a numerical study to evaluate the thermal-hydraulic performance of a plain-fin oblique-tube model.

FIGS. 8A to 8C are illustrations of a numerical study to evaluate the air-side pressure drop of a plain-fin oblique-tube model.

DETAILED DESCRIPTION

Figure 1A:
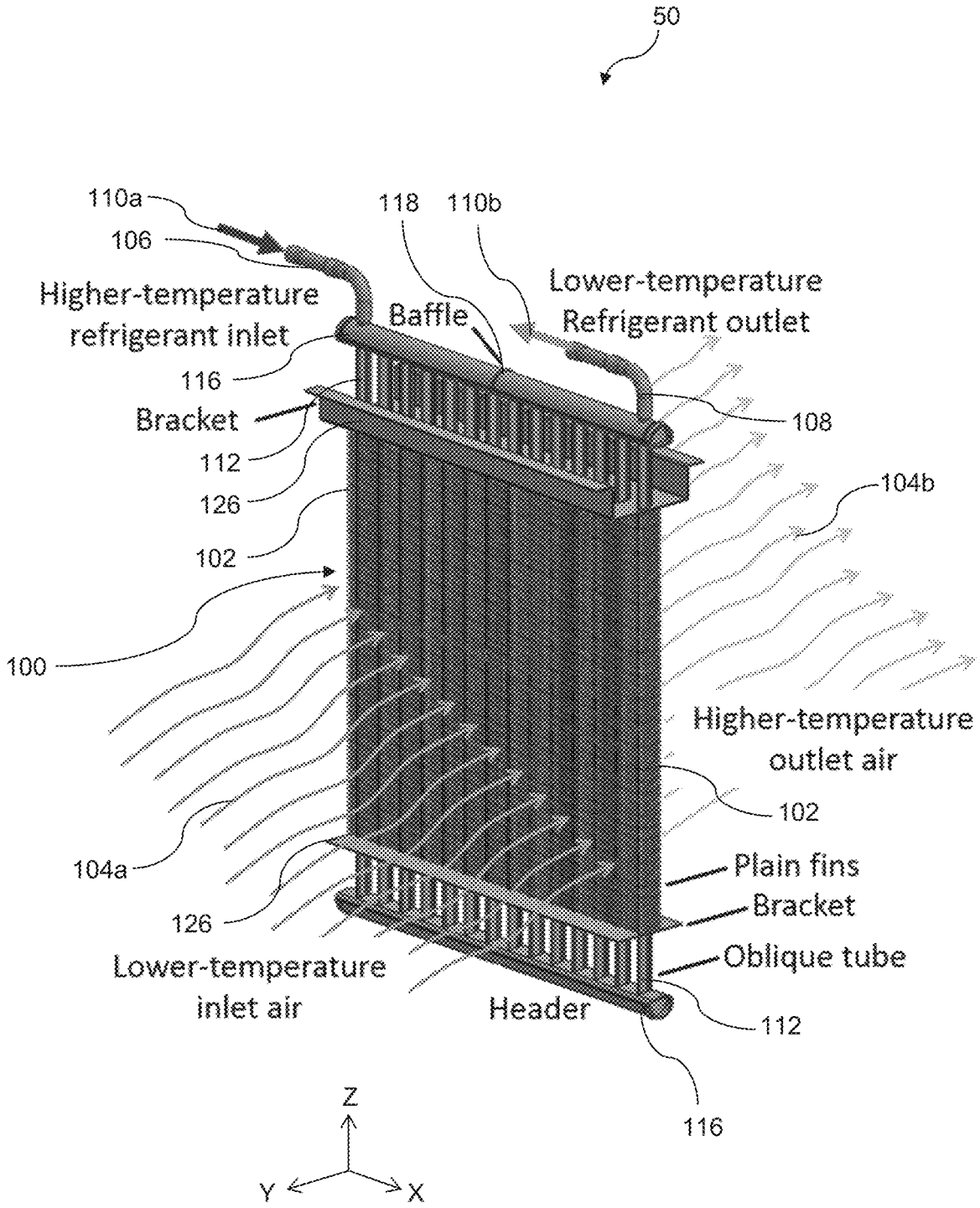
FIGS. 1A to 1D are illustrations of various views of a heat exchanger comprising a heat exchange unit.

For purposes of brevity and clarity, descriptions of embodiments of the present disclosure are directed to a heat exchange unit for a heat exchanger and a method for manufacturing the heat exchange unit, in accordance with the drawings. While aspects of the present disclosure will be described in conjunction with the embodiments provided herein, it will be understood that they are not intended to limit the present disclosure to these embodiments. On the contrary, the present disclosure is intended to cover alternatives, modifications and equivalents to the embodiments described herein, which are included within the scope of the present disclosure as defined by the appended claims. Furthermore, in the following detailed description, specific details are set forth in order to provide a thorough understanding of the present disclosure. However, it will be recognised by an individual having ordinary skill in the art, i.e. a skilled person, that the present disclosure may be practiced without specific details, and/or with multiple details arising from combinations of aspects of particular embodiments. In a number of instances, well-known systems, methods, procedures, and components have not been described in detail so as to not unnecessarily obscure aspects of the embodiments of the present disclosure.

In embodiments of the present disclosure, depiction of a given element or consideration or use of a particular element number in a particular figure or a reference thereto in corresponding descriptive material can encompass the same, an equivalent, or an analogous element or element number identified in another figure or descriptive material associated therewith.

References to "an embodiment/example", "another embodiment/example", "some embodiments/examples", "some other embodiments/examples", and so on, indicate that the embodiment(s)/example(s) so described may include a particular feature, structure, characteristic, property, element, or limitation, but that not every embodiment/example necessarily includes that particular feature, structure, characteristic, property, element or limitation. Furthermore, repeated use of the phrase "in an embodiment/example" or "in another embodiment/example" does not necessarily refer to the same embodiment/example.

The terms "comprising", "including", "having", and the like do not exclude the presence of other features/elements/steps than those listed in an embodiment. Recitation of certain features/elements/steps in mutually different embodiments does not indicate that a combination of these features/elements/steps cannot be used in an embodiment.

As used herein, the terms "a" and "an" are defined as one or more than one. The use of "/" in a figure or associated text is understood to mean "and/or" unless otherwise indicated. The term "set" is defined as a non-empty finite organisation of elements that mathematically exhibits a cardinality of at least one (e.g. a set as defined herein can correspond to a unit, singlet, or single-element set, or a multiple-element set), in accordance with known mathematical definitions. The recitation of a particular numerical value or value range herein is understood to include or be a recitation of an approximate numerical value or value range.

Figure 1B:
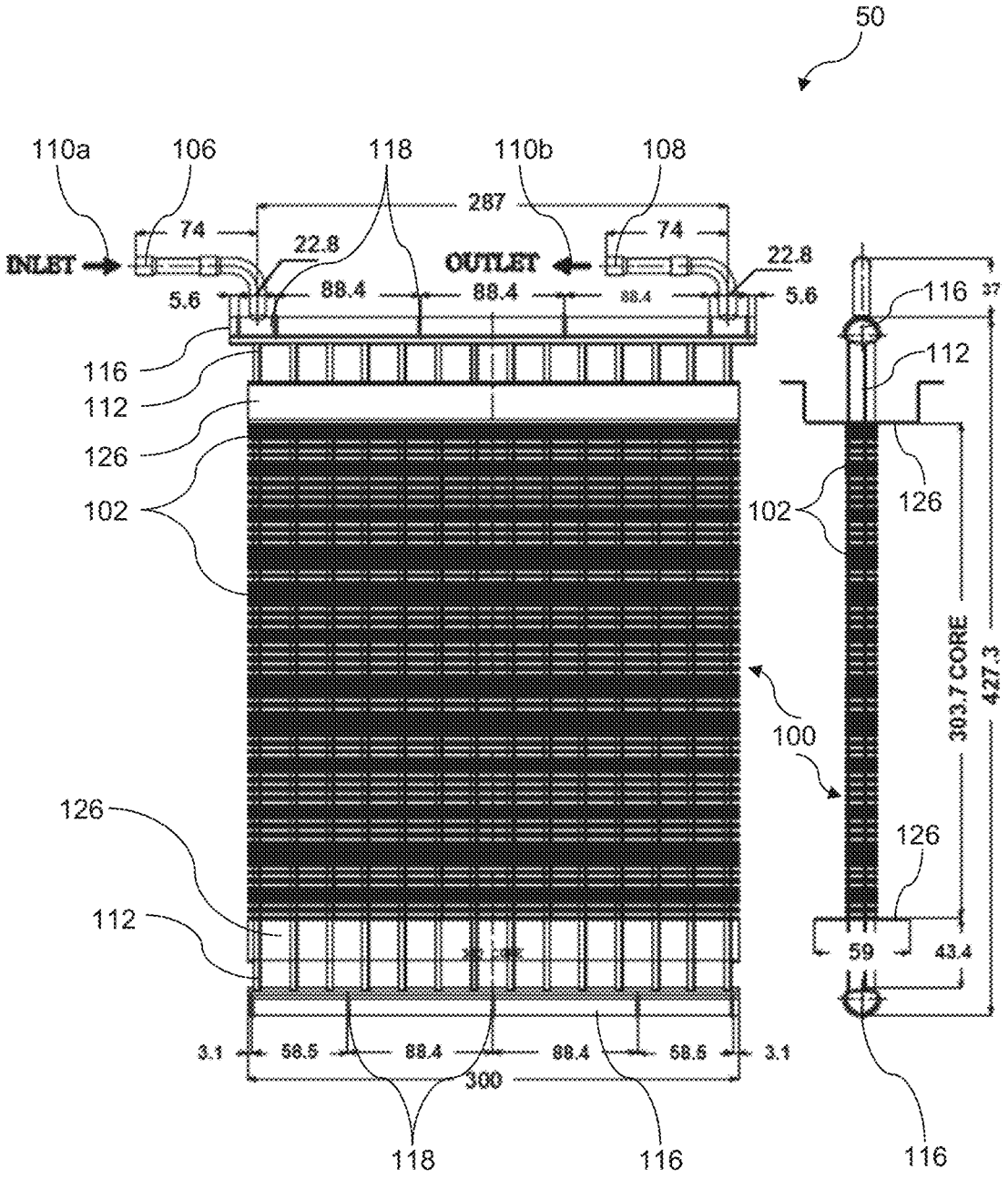

In representative or exemplary embodiments of the present disclosure, there is a heat exchanger 50 and a heat exchange unit 100 for the heat exchanger 50, as shown in FIGS. 1A and 1B. Various embodiments are described in relation to the heat exchange unit 100 configured for forming or assembling to the heat exchanger 50, as well as the heat exchanger 50 which includes the heat exchange unit 100. The heat exchange unit 100 may also be referred to as a heat exchange core or a condenser coil.

The heat exchange unit 100 includes a plurality of plain fins 102 stacked perpendicularly to a first plane. The plain fins 102 are plate fins with a flat surface profile. Notably, the plain fins 102 are perpendicular to a second plane normal to the first plane, and are parallel to a third plane that is normal to both the first and second planes. As shown in FIG. 1A, the first plane refers to the XZ-plane, the second plane refers to the YZ-plane, and the third plane refers to the XY-plane. A first fluid 104 is communicable through the first plane between the plain fins 102. Communication or flow of the first fluid 104 is represented in FIG. 1A as inlet first fluid 104*a* and outlet first fluid 104*b*. The heat exchanger 50 includes an inlet 106 and an outlet 108. The inlet 106 is configured for receiving a second fluid 110 and the outlet 108 is configured for discharging the second fluid 110. Communication or flow of the second fluid 110 is represented in FIG. 1A as inlet second fluid 110*a* and outlet second fluid 110*b*. In many embodiments, the first fluid 104 is air and the second fluid 110 is water or a refrigerant (e.g. R401A), but may be other fluids depending on the operational requirements/applications of the heat exchanger 50/heat exchange unit 100, as will be readily understood by the skilled person.

The heat exchange unit 100 further includes a plurality of tubes 112 for communicating the second fluid 110 therethrough for heat exchange with the first fluid 104. When assembled to form the heat exchanger 50, the tubes 112 are fluidically communicative with the inlet 106 and outlet 108 for communicating the second fluid 110. For example, in this heat exchange, the inlet first fluid 104*a* is at a lower temperature than the outlet first fluid 104*b*, and the inlet second fluid 110*a* is at a higher temperature than the outlet second fluid 110*b*. The first fluid 104 is heated as a result of removing heat from the second fluid 110, thereby cooling the second fluid 110.

Figure 1C:
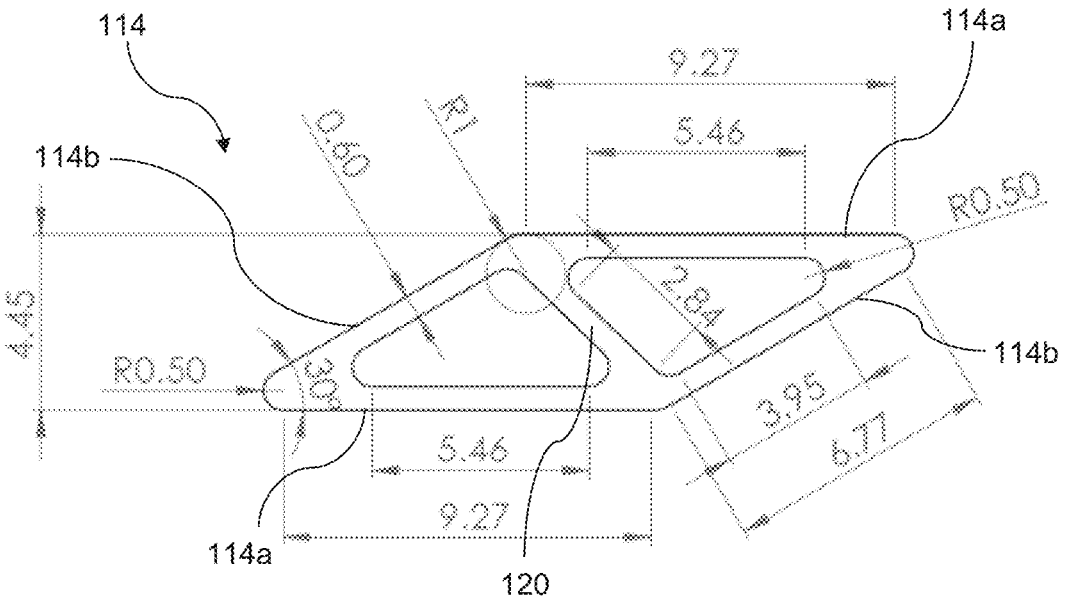
Figure 1D:
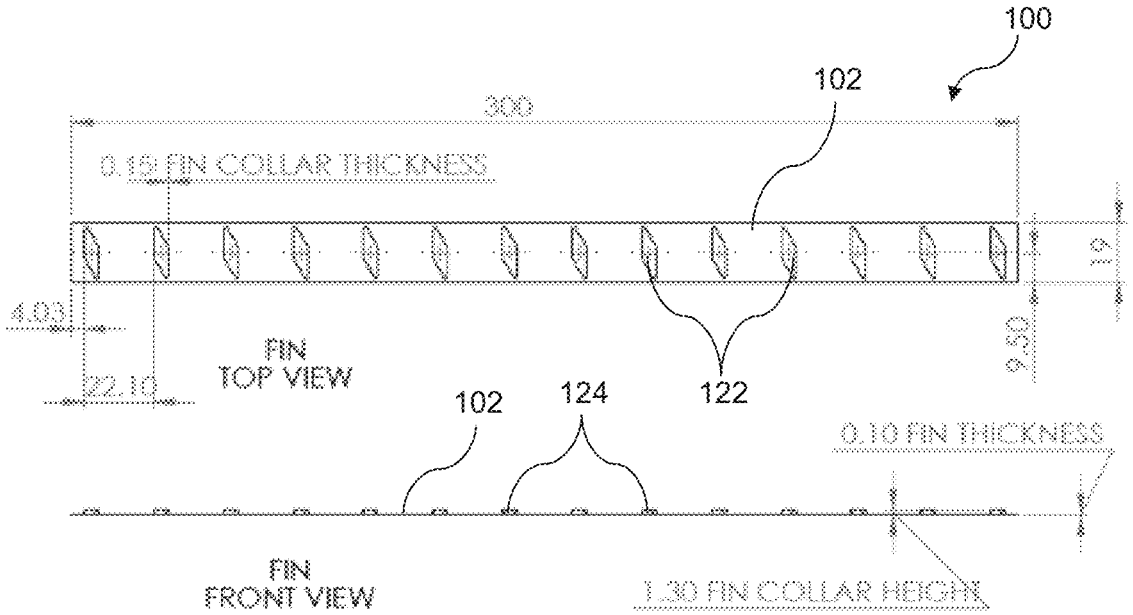

Further with reference to FIGS. 1C and 1D, the tubes 112 extend perpendicularly through the plain fins 102 and has an oblique cross-section 114. The oblique cross-section 114 has an oblique geometry that is distorted so that it seems to "lean over" at an angle, as opposed to being upright. In many embodiments as shown in FIG. 1C, the oblique cross-section 114 has a parallelogram geometry as opposed to an upright rectangular geometry. The oblique cross-section 114 has a pair of opposing first sides 114*a* and a pair of opposing second sides 114*b*. For each oblique cross-section 114, the first sides 114*a* are perpendicular to the first plane and the second sides 114*b* are angled approximately 60° to the first plane. In other words, a first side 114*a* and a second side 114*b* form an angle of attack of approximately 30° at the first plane. Additionally, each of the first sides 114*a* is longer than each of the second sides 114*b*, giving the oblique cross-section 114 an elongated profile extending perpendicularly from the first plane. This allows the tubes 112 to have a slender streamline profile relative to the communication of the first fluid 104 through the first plane. As the tubes 112 have an oblique cross-section 114, the tubes 112 may be referred to as oblique tubes 112.

FIG. 1D illustrates the heat exchange unit 100 having the oblique tubes 112 arranged along a single row of each plain fin 102 and along the first plane. The tubes 112 thus form a 1-row condenser coil. However, it will be appreciated that the tubes 112 may be arranged differently to form other condenser coil designs, such as but not limited to, a 2-row condenser coil and a tube bank having multiple rows or an array of tubes 112.

Figure 2:
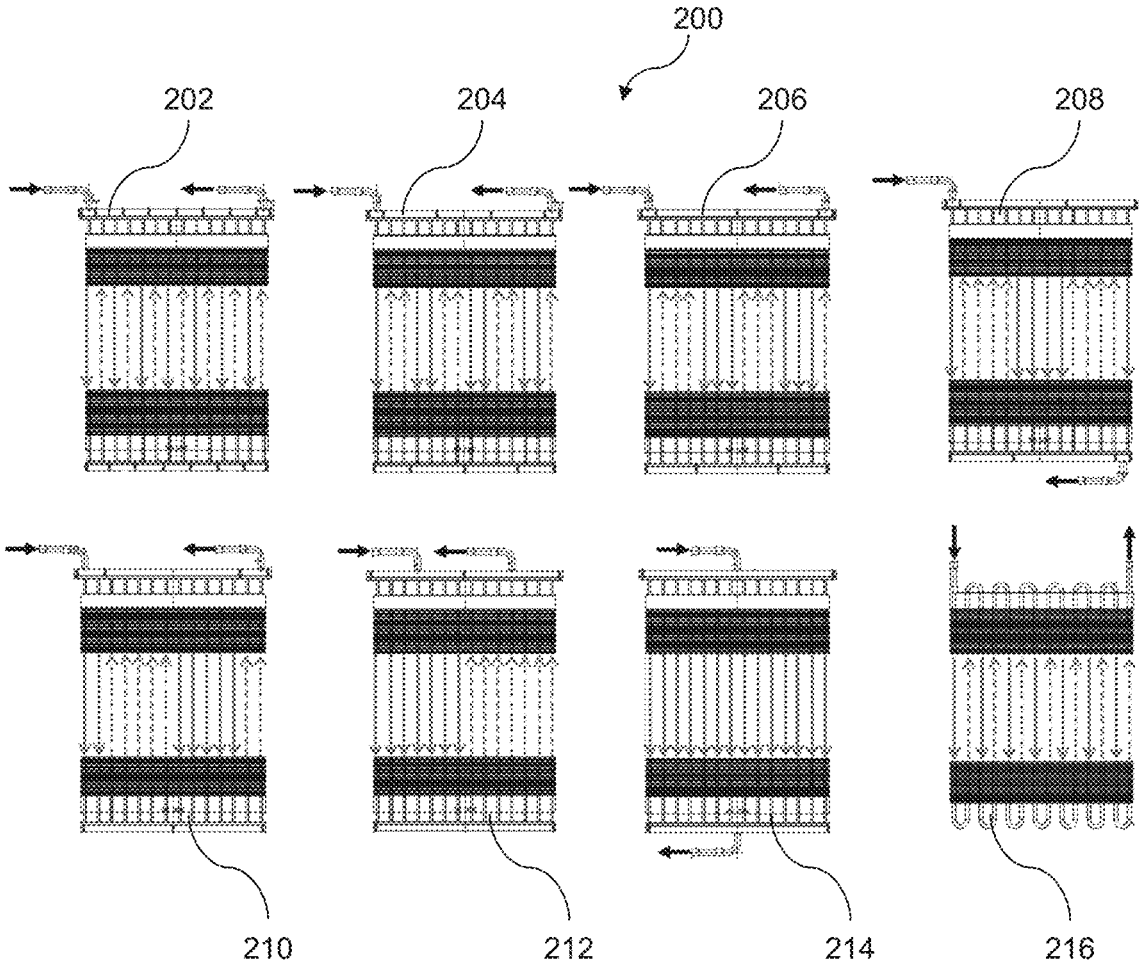
FIG. 2 is an illustration of various examples of the heat exchanger having different arrangements.

In some embodiments, the heat exchanger 50 includes a set of headers 116 joined to the oblique tubes 112, the headers 116 being fluidically communicative with the inlet 106 and outlet 108. Each header 116 includes a set of baffles 118 for distributing the second fluid 110 through the oblique tubes 112. In some other embodiments, the heat exchanger 100 includes a set of connecting elbows, e.g. U-shaped tubes, joined to adjacent tubes 112 for communicating the second fluid 110 continuously through the oblique tubes 112. Each connecting elbow has oblique cross-sectional ends that match the oblique cross-section 114 of the tubes 112. FIG. 2 illustrates various examples 200 of the heat exchanger 50 incorporating the headers 116 (heat exchangers 202, 204, 206, 208, 210, 212, and 214) in comparison with an existing heat exchanger 216 having circular tubes in a coil arrangement. The heat exchanger 50 may alternatively incorporate connecting elbows to achieve a coil arrangement of oblique tubes 112 similar to the heat exchanger 216.

As shown in FIGS. 2(*a*) to 2(*g*), each of the heat exchangers 202 to 214 has two headers 116 with baffles 118 to distribute the second fluid 110 through the oblique tubes 112 which are arranged in coils. The locations of the baffles 118 determine how many tubes per pass the second fluid 110 flows through, which in turn affects the efficiency of heat exchange. The heat exchangers 202 to 214 have 1-tube-per-pass, 2-tubes-per-pass, 3-tubes-per-pass, 4-tubes-per-pass, 5-tubes-per-pass, 7-tubes-per-pass and 14-tubes-per-pass designs, respectively, that create different flow paths of the second fluid 110. The 14-tubes-per-pass design of the heat exchanger 214 may be referred to as a parallel-flow design. In the heat exchangers 202, 204, 206, and 208, each coil has one tube 112 at the first pass and the last pass before the rest of the tubes 112 is equally divided into 1, 2, 3, and 4 tubes per pass, respectively. The heat exchanger 210 has 2 tubes 112 at the first pass and the last pass before the rest of the tubes 112 is equally divided into 5 tubes per pass. The number of tubes 112 in the heat exchangers 212 and 214 is equally divided into 7 and 14 tubes per pass, respectively. As a reference, FIG. 2(*h*) shows the heat exchanger 216 having circular tubes in a coil arrangement for communication of fluid in a serpentine manner similar to the heat exchanger 202, i.e. the 1-tube-per-pass design. The heat exchanger 216 is based on an existing household AC condenser coil which has circular tubes and corrugated fins, instead of the plain fins 102 and oblique tubes 112 of the other heat exchangers 202 to 214 shown in FIGS. 2(*a*) to 2(*g*).

Figure 3:
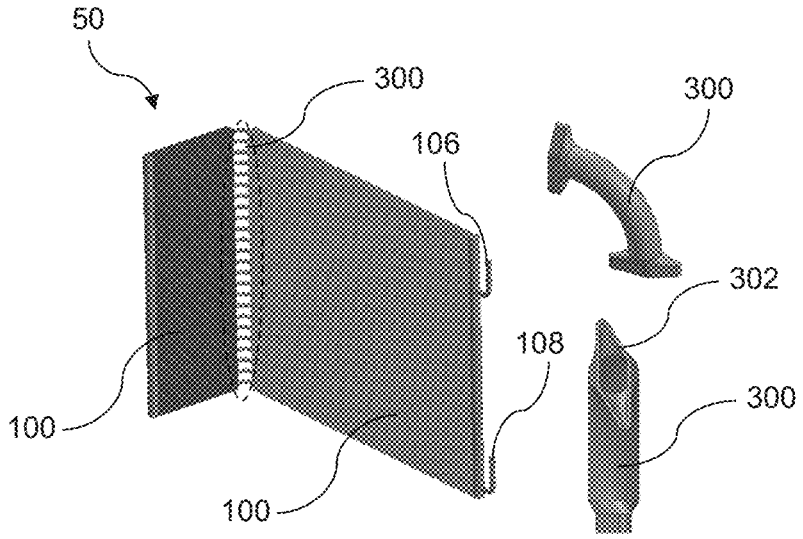
FIG. 3 is an illustration of extension elbows for the heat exchanger.

In some embodiments with reference to FIG. 3, the heat exchanger 50 includes a plurality of extension elbows 300 for joining the tubes 112 of the heat exchange unit 100 to another plurality of tubes 112 of another heat exchange unit 100. As shown in FIGS. 3(*a*) and 3(*b*), the extension elbows 300 are L-shaped tubes that join two separate sets of oblique tubes 112 to form a more compact heat exchanger 50. Due to space constraints related to packing, many commercial products such as outdoor fan coil units (e.g. a residential AC outdoor unit) require heat exchange units 100 in an L-shaped arrangement to make the heat exchanger 50 or outdoor unit more compact. As shown in FIG. 3(*c*), each extension elbow 300 has oblique cross-sectional ends 302 that match the oblique cross-section 114 of the tubes 112. Each extension elbow 300 may be made from a circular tube having the same perimeter as the oblique tube 112. The ends 302 of the extension elbow 300 are expanded with an oblique-shaped tool and the middle portion of the extension elbow 300 is bent by a bending process. The baffles 118 may be arranged at suitable locations to control distribution of the second fluid 110 across both sets of tubes 112. Although FIG. 3 illustrates the heat exchanger 50 in an L-shaped form, it will be appreciated that the extension elbows 300 may be modified to form heat exchangers 50 of other forms, such as an inclined-shaped form.

Referring to FIG. 1C, each oblique tube 112 optionally includes an internal rib 120 extending therethrough to strengthen the tube 112 and increase its rigidity. The internal rib 120 may not be necessary for lower internal pressure applications of the heat exchanger 50/heat exchange unit 100, such as if the second fluid 110 is gaseous. However, for higher internal pressure applications, for example as high as 50 bars, the internal rib 120 in the middle of each oblique tube 112 improves safety, mitigates risk of deformation of the oblique tubes 112, and allows wider adoption of the heat exchanger 50/heat exchange unit 100 for various high-pressure applications. Each oblique tube 112 may be filleted at edges thereof represented by corners of the oblique cross-section 114. While sharp corners may be preferred to improve the streamline profile of the oblique cross-section 114, the sharp edges of the oblique tubes 112 may be filleted due to manufacturing limitations of the mould making process used to make the mould for extruding the oblique tubes 112. For practical extrusion of the oblique tubes 112, the corners of the oblique cross-section 114 may be filleted to a minimum radius of 0.5 mm. For example, the acute corners are filleted to 0.5 mm and the obtuse corners are filleted to 1 mm.

With reference to FIG. 1D, each plain fin 102 includes a plurality of holes 122 where the oblique tubes 112 are inserted through. Each hole 122 has a shape or profile matching the oblique cross-section 114. The holes 122 in the plain fins 102 may be formed such that the oblique tubes 112 are identically oriented relative to the first plane. Furthermore, each plain fin 102 may include a plurality of collars 124 joining the oblique tubes 112 to the plain fin 102. The collars 124 are formed at the peripheries of the holes 122 and protrude or extend perpendicularly from the flat surface of the plain fin 102. The collars 124 are in contact with the tubes 112 and join the tubes 112 to the plain fin 102 by a joining process such as brazing described below. The holes 122 may be filleted in a similar manner as the corners of the oblique cross-section 114.

The oblique tubes 112 may be joined to the plain fins 102 using various means known to the skilled person. In some embodiments, the oblique tubes 112 are joined to the plain fins 102 by a joining process such as brazing. More broadly, various parts of the heat exchange unit 100 and heat exchanger 50, including the plain fins 102, inlet 106, outlet 108, oblique tubes 112, headers 116, baffles 118, and elbows 300, may be joined by brazing. Brazing is a metal-joining process in which two metal parts are joined together by melting a filler into the joint and bonds the two metal parts together. One example of a brazing process is the controlled atmospheric brazing (CAB) process. Manufacturing of existing heat exchangers relies on mechanical tube expansion to join the tubes to the fins which unavoidably yields air gaps and thus high thermal contact resistance between the tubes and fins. Additionally, the heat exchange unit formed by the tubes and fins have to be separately assembled to other parts of the heat exchanger such as the headers, baffles, inlet, and outlet, by other joining processes such as brazing or welding, thus requiring more time to manufacture the heat exchanger.

Existing heat exchangers use circular tubes and mechanical tube expansion is not suitable for non-circular tubes, particularly the oblique tubes 112 of the heat exchange unit 100. The CAB process improves the joining quality between the various parts of the heat exchange unit 100 and heat exchanger 50, specifically between the plain fins 102 and the oblique tubes 112, by reducing the thermal contact resistance at the joints. Additionally, the CAB process can be used to braze various parts of the heat exchange unit 100 and heat exchanger 50 in a single process, thus avoiding the separate mechanical tube expansion and joining processes of existing heat exchangers. By using the CAB process to join the various parts in a single process, the assembly time of the heat exchanger 50, including joining of the heat exchange unit 100 core to other parts such as the inlet 106, outlet 108, headers 116, and baffles 118, is reduced. Furthermore, by reducing the manufacturing time, scalability can be increased and the heat exchanger 50 can be manufactured in on a large-scale basis.

Figure 4A:
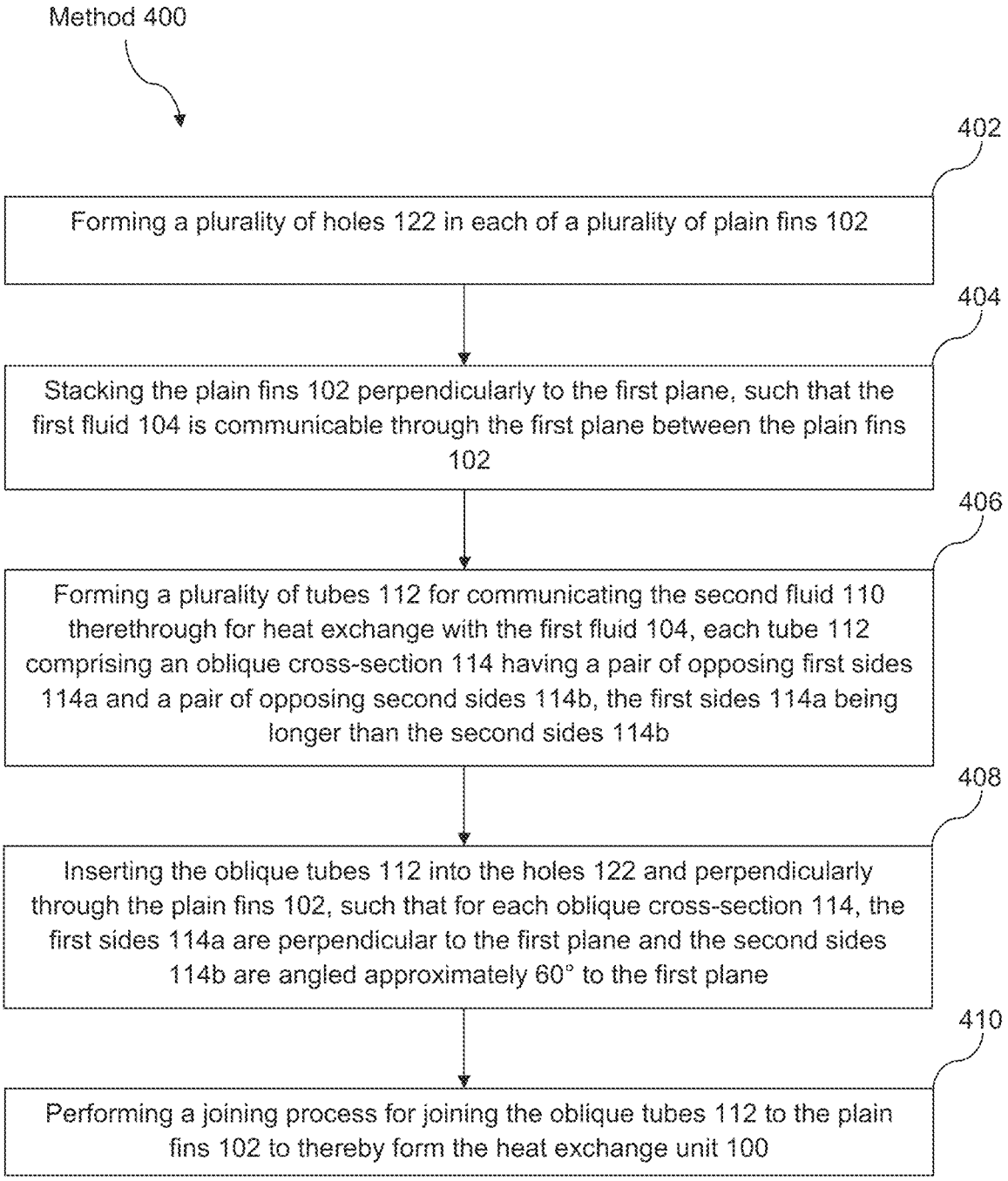
FIGS. 4A and 4B are illustrations of a method for manufacturing the heat exchanger.
Figure 4B:
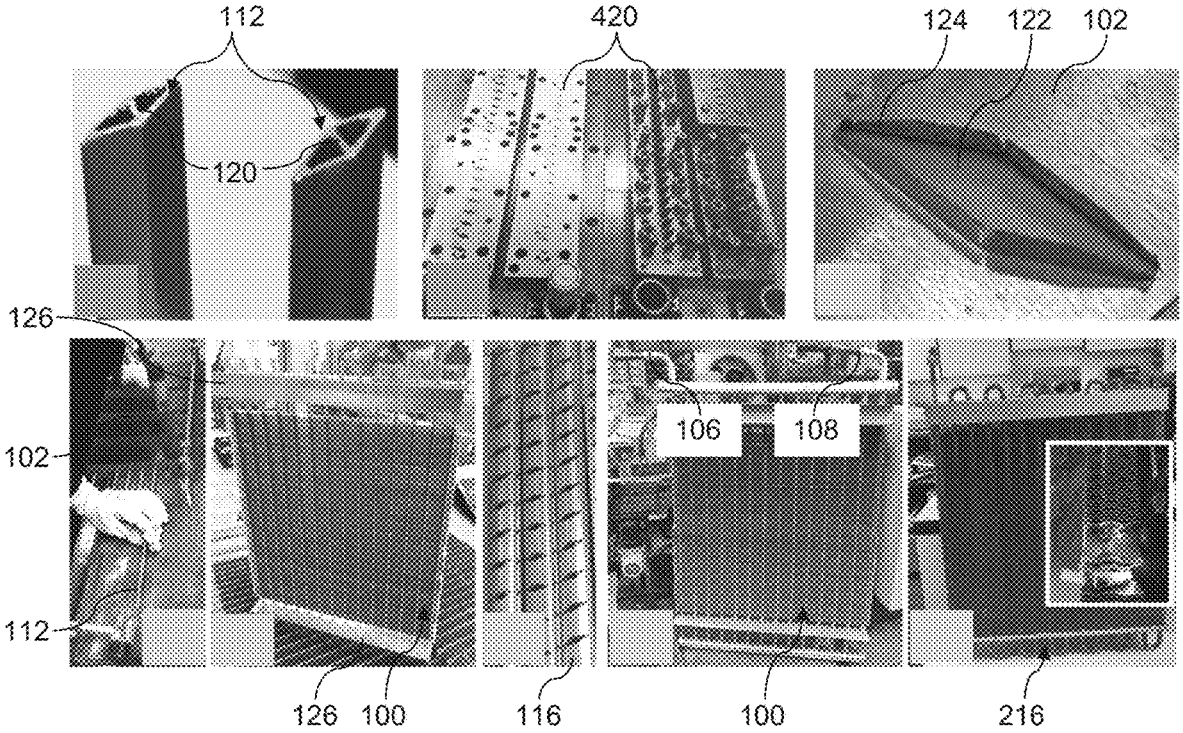

In various embodiments of the present disclosure with reference to FIGS. 4A and 4B, there is a method 400 for manufacturing the heat exchange unit 100 for the heat exchanger 50. It will be appreciated that various aspects in relation to the heat exchange unit 100 described herein apply similarly or analogously to the method 400 for manufacturing the heat exchange unit 100 and vice versa.

The method 400 includes a step 402 of forming a plurality of holes 122 in each of a plurality of plain fins 102. Each plain fin 102 has a thickness ranging from 0.10 mm to 0.15 mm and is formed of metal material, such as aluminium, brass, copper, or a combination thereof. For example, the plain fins 102 are formed of an aluminium material, such as AA 6063-T5 aluminium alloy. Said forming of the holes 122 in each plain fin 102 may include forming a collar 124 at each hole 122 for joining the oblique tubes 112 to the plain fin 102. The holes 122 may be formed in the plain fins 102 using a patterned die set 420 as shown in FIG. 4B(b). Specifically, the patterned die set 420 cuts through or pierces the plain fins 102 such that the collars 124 are formed as a result. FIG. 4B(c) shows the collars 124 having non-uniform heights and slightly removed corners to mitigate risk of breakage of the plain fins 102 when the tubes 112 are inserted through the holes 122 subsequently. The holes 122 may alternatively be formed by other processes, such as laser cutting.

The method 400 includes a step 404 of stacking the plain fins 102 perpendicularly to the first plane, such that the first fluid 104 is communicable through the first plane between the plain fins 102. Said stacking of the plain fins 102 may include disposing spacers between the plain fins 102. The spacers may have a thickness of approximately 1.25 mm to achieve a uniform fin pitch of approximately 1.4 mm during insertion of the tubes 112.

The method 400 includes a step 406 of forming a plurality of tubes 112 for communicating the second fluid 110 therethrough for heat exchange with the first fluid 104. Each tube 112 includes an oblique cross-section 114 having a pair of opposing first sides 114*a* and a pair of opposing second sides

114*b*, the first sides 114*a* being longer than the second sides 114*b*. As shown in FIG. 4B(a), each tube 112 has the oblique cross-section 114 and may include an internal rib 120 extending therethrough. The oblique tubes 112 are formed by an extrusion process using a mould with a tolerance of ±0.15 mm to ±0.18 mm. As mentioned above, sharp edges of the oblique tubes 112 are filleted due to manufacturing limitations of making the mould. The oblique tubes 112 may be formed of a metal material such as aluminium, brass, copper, or a combination thereof. For example, the oblique tubes 112 are formed of an aluminium material, such as AA 6063-T5 aluminium alloy.

The method 400 includes a step 408 of inserting the oblique tubes 112 into the holes 122 and perpendicularly through the plain fins 102, such that for each oblique cross-section 114, the first sides 114*a* are perpendicular to the first plane and the second sides 114*b* are angled approximately 60° to the first plane. As shown in FIG. 4B(d), the plain fins 102 are stacked and secured by a clamp before the oblique tubes 112 are inserted through the holes 122. Insertion of the oblique tubes 112 may be manual with the help of hammers, or adapted to an automatic process for large scale production. Supporting plates or brackets 126 may be added so that the heat exchange unit 100, or the heat exchanger 50 including the heat exchange unit 100, can be supported on other structures, such as on a test section of a wind tunnel as shown in FIG. 4B(e). The method 400 includes a step 410 of performing a joining process for joining the oblique tubes 112 to the plain fins 102 to thereby form the heat exchange unit 100.

The heat exchange unit 100 may be joined to a set of headers 116 in forming or assembling the heat exchanger 50. As shown in FIG. 4B(f), each header 116 includes oblique-shaped holes corresponding to the oblique cross-section 114 for insertion of the oblique tubes 112. Each header 116 also includes slits for assembling a set of baffles 118 for distributing the second fluid 110 through the oblique tubes 112. The holes and slits of the headers 116 may be formed by laser cutting. In some other embodiments, the method 400 includes joining a set of connecting elbows, e.g. U-shaped tubes, to adjacent oblique tubes 112 for communicating the second fluid 110 continuously through the oblique tubes 112 in a serpentine manner, each connecting elbow having oblique cross-sectional ends that match the oblique cross-section 114.

The heat exchange unit 100 may be joined to the inlet 106 and outlet 108 in forming or assembling the heat exchanger 50. The inlet 106 and outlet 108 are configured for receiving and discharging the second fluid 110, respectively. The inlet 106 and outlet 108 and are fluidically communicative with the oblique tubes 112 for communicating the second fluid 110 therethrough for heat exchange with the first fluid 104. As shown in FIG. 4B(g), the inlet 106 and outlet 108 may be joined to the headers 116 such that the headers 116 are fluidically communicative with the inlet 106 and outlet 108.

In some embodiments, the joining process includes brazing or a brazing process such as the CAB process. The CAB process may be used to braze and join the oblique tubes 112 to the plain fins 102, as well as for other parts of the heat exchanger 50/heat exchange unit 100. An example of the CAB process performed to form the heat exchange unit 100 is described below. The CAB process was performed using a furnace, and a flux and a filler were uniformly distributed on surfaces of the heat exchange unit 100. The flux promotes wetting which lets the filler flow over the metal parts to be joined and the loading of the flux was approximately 5 g/m$^2$. The flux cleaned the parts of oxides of the metal parts so that the filler bonded more tightly to the metal parts. The brazing speed was approximately 930 mm/min and the speed should not be too slow as it may dry out the flux. A series of controlled temperatures was used in the CAB process, including 3 pre-heating temperatures of 120° C., 140° C., and 150° C. before reducing back to 120° C. The series of controlled temperatures also included 6 heating temperatures of 580° C., 590° C., 595° C., 600° C., 605° C., and 600° C., a slow cooling temperature of 390° C., and exiting temperature of 250° C., and a final air blast temperature of 50° C. The brazed heat exchange unit 100 was cooled naturally to ambient temperature. Brazing should be performed at the maximum temperature for no more than 5 minutes to avoid filler metal erosion. Upon melting, the filler alloy flowed through capillary gaps for joining the parts.

Both dry and wet leak tests were performed to ensure the heat exchange unit 100 is safe before the heat exchanger 50/heat exchange unit 100 is tested and evaluated subsequently. The dry leak test relied on a helium leak detector to test if the heat exchange unit 100 is able to withhold helium gas at 40 bars for 20 seconds. The wet leak test tested if there were rising air bubbles when the heat exchange unit 100 was submerged in a water tank and applied with soapy water. Suitable pre-heating and heating temperatures are important to obtain good brazing and joint quality to prevent leakages and to provide high heat transfer efficiency. Moreover, the internal ribs 120 in the oblique tubes 112 mitigates deformation of the tubes 112. For typical residential AC systems, the maximum refrigerant pressure is approximately 30 bars and passing the leak tests would allow the heat exchange unit 100 to be adopted by various manufacturers to produce heat exchangers 50 and AC systems.

Figure 5:
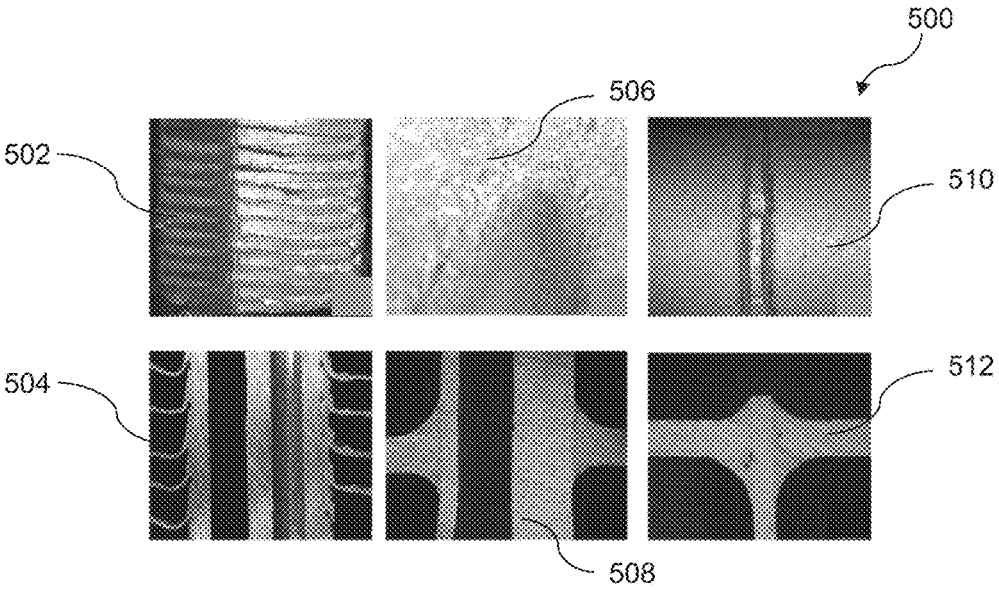
FIG. 5 is an illustration of brazed joints of the heat exchanger.

Cross-sectional brazing quality was investigated by cutting and viewing the cross-sections of joints with a metallurgical microscope. Views 500 of the various joints are shown in FIG. 5. FIGS. 5(*a*) and 5(*b*) show views 502 and 504 of the brazed joints between the plain fins 102 and oblique tubes 112. Adjacent plain fins 102 were assembled tightly and no overlapping between the plain fins 102 was observed. The contacts or joints between the plain fins 102 and oblique tubes 112 were observed to be properly jointed by the filler for effective heat transfer. FIGS. 5(*c*) and 5(*d*) show views 506 and 508 of the brazed joints between the oblique tubes 112 and a header 116. FIGS. 5(*e*) and 5(*f*) show views 510 and 512 of the brazed joints between the header 116 and baffles 118. The CAB process is thus excellent for joining oblique tubes 112 (or other non-circular or arbitrary-shaped tubes) to the plain fins 102 as well as for other parts, and can effectively seal the joints as the heat exchange unit 100 is able to pass the leak tests of up to 40 bars.

Figures 6B, 7A:
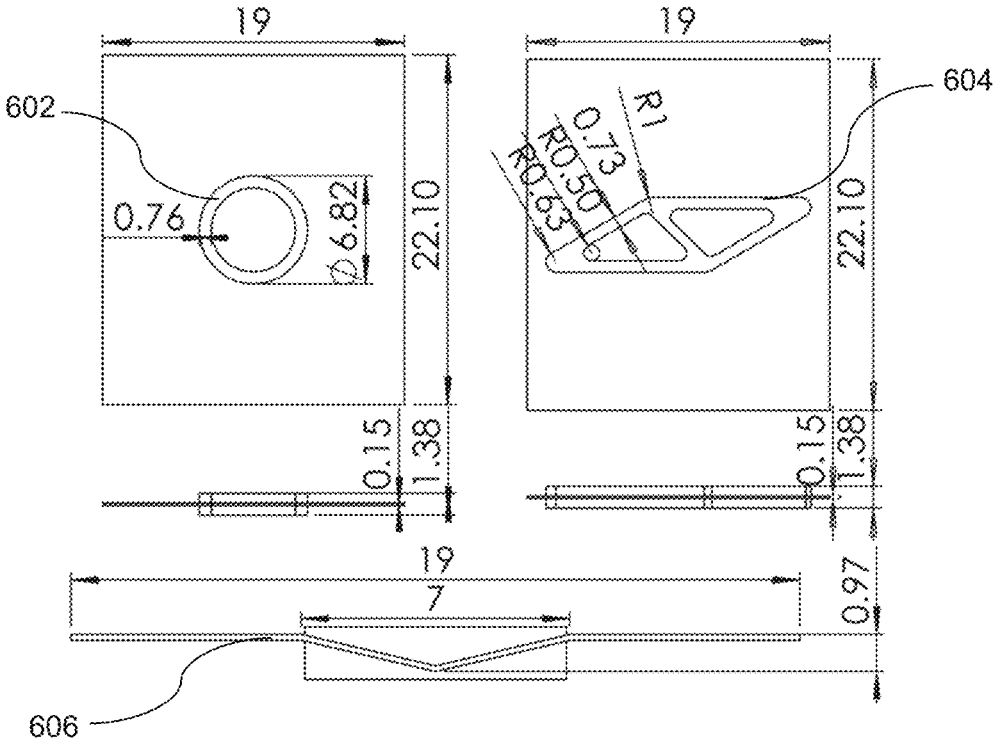

Various simulations and experiments were performed evaluate the heat exchange unit 100 and compare it with other FTHXs. Models of the heat exchange unit 100 and other FTHXs were built based on a common commercial 2.5 kW single split household AC with a condenser coil having corrugated fins and circular tubes (CFCT design). An example of the CFCT design with a serpentine flow coil is shown as the heat exchanger 216 in FIG. 4B(h). The heat exchange unit 100 has plain fins 102 and oblique tubes 112 and may be referred to as the PFOT design. Other FTHX designs include the PFCT design of plain fins with circular tubes, and the CFOT design of corrugated fins and oblique tubes. Various dimensions and properties of the 4 designs are shown in Table 600 in FIG. 6A. FIGS. 6B(a) to 6B(c) show various dimensions of a model 602 of the PFCT design, a model 604 of the PFOT design, and a corrugated fin 606, respectively. The CFCT design is used as the reference or baseline for the other 3 designs. The overall fin size, fin thickness, and fin gap are the same for each design. The internal tube area for the oblique tubes 112 is kept approximately the same as that of the circular tube to represent the same flow rate condition in order to evaluate the thermal-hydraulic performance of each design.

A computer simulation was performed on the PFOT design model to simulate and analyse the von Mises stress experienced by the heat exchange unit 100. The model was built with an internal rib 120 of different thicknesses to compare the strengthened oblique tube 112 against an oblique tube 112 without the internal rib 120. Both ends of the model were fixed constraints and a pressure of 30 bars was simulated on the internal walls of the oblique tubes 112. The 30-bar pressure was selected as the household AC uses a R410A refrigerant wherein the operating pressure is approximately 22 to 28 bars. The internal edges of the oblique tube 112 without the internal rib 120 have a maximum stress of over 188 MPa, exceeding the tensile yield strength of common metal materials for the oblique tube 112. For example, copper has a yield strength of approximately 70 MPa. The maximum stress was significantly reduced to 82 MPa for the oblique tube 112 with a 0.6 mm thick internal rib 120. The maximum stress was further reduced to 52 MPa for the oblique tube 112 with a 1 mm thick internal rib 120. Aluminium has a yield strength of approximately 241 MPa and would be suitable for forming the oblique tubes 112. Accordingly, with appropriate design of the internal rib thickness, tube wall thickness, and choice of material, it is shown that the oblique tube 112 could be used for the heat exchange unit 100 of the residential AC at an operating condensation pressure of up to 30 bars.

A CFD (computational fluid dynamics) FTHX model with 3-fin span-wise length (66.3 mm) and 3 oblique tubes 112 was built to evaluate the thermal-hydraulic performance of heat exchange units or condenser coils in all 4 designs. The 3-fin and 3-tube model was used because the performance of the centre tube, where the results were extracted for performance evaluation, was affected by the adjacent tubes while the influence of the rest of the further tubes was less or insignificant. The computational domain was extended half fin depth (9.5 mm) before the model to eliminate any non-uniformity of the flow and one fin depth (19 mm) after the model to avoid backflow from the outlet. The periodical repetition of the tubes in the condenser coil was represented by setting the upper and lower surfaces of the computational domain as the periodic boundary condition, while the sides of the computational domain were set as the slip stationary wall to eliminate the wall shear effect on the flow.

Table 700 in FIG. 7A compares the thermal-hydraulic performance of the PFCT design with slip stationary wall and symmetry boundary conditions. Specifically, the Table 700 compares the numerical results of the heat transfer amount (Q) and air-side pressure drop or pressure difference (Δp) of the computational domain. The heat transfer amount represents the amount of heat removed from the refrigerant by the air, and the air-side pressure drop represents the difference or drop in air pressure across the PFCT coil. It is shown in Table 700 that, with slip stationary wall or symmetry boundary condition, the results of the centre tube computational domain for the PFCT design are the same—the difference in heat transfer amount and air-side pressure drop is less than 1%. This is because both boundary conditions have the same mathematical equation, which is zero velocity gradient at the boundary. As such, the slip stationary wall boundary condition was adopted for 3-fin and 3-tube model with non-symmetrical tubes like the oblique tubes 112.

Figures 7B, 8A:
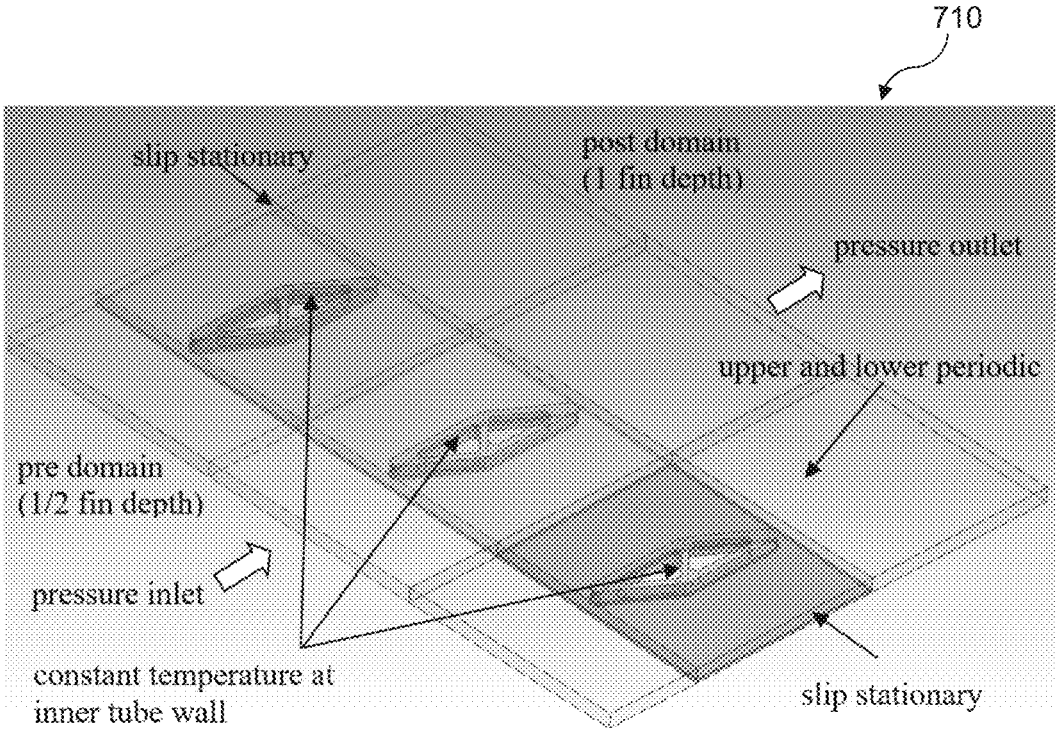

To simulate the negative suction of the draw-through fan of the household AC, pressure inlet and pressure outlet with a target mass flow rate was used. The inlet air temperature was set at 35° C. based on Singapore's typical outdoor temperature on a hot day. Various properties of the air are dependent on the temperature. The inner wall of the oblique tubes 112 was set at a constant wall temperature of 45° C., which is the constant operating condensation temperature of the R410A refrigerant at 28 bars. FIG. 7B shows a CFD model 710 of the PFOT design, i.e. modelling the plain fins 102 and oblique tubes 112 of the heat exchange unit 100. The CFD model 710 shows the 3D computational domain and boundary conditions of the PFOT design.

Due to flow separation and resulting rapid changes in air flow velocity near the oblique tubes 112, fully turbulent flow was assumed between the plain fins 102. The conjugate heat transfer between the CFD model 710 and a turbulent flow governed by the realisable K-epsilon (k-ε) turbulence model was solved computationally. The numerical study of the thermal-hydraulic performance of the CFD model 710 was carried out by under steady-state conditions, i.e. steady-state fluid flow and transfer. Negligible viscous dissipation, natural convection, and radiation heat transfer were ignored. Iteration convergence was considered to be achieved when the target mass flow rate corresponding to inlet air velocity ranging from 1.0 m/s to 3.0 m/s was reached and remained constant, with the following residual convergence criteria satisfied—(i) residual of the continuity is less than $10^{-4}$; (ii) residual of the velocity components is less than $10^{-8}$; and residual of the energy is less than $10^{-8}$.

As the mass flow rate and the overall fin size are the same for the circular tube and oblique tube designs, other parameters used for direct comparison of the thermal-hydraulic performance of different finned tube designs. These parameters include the air-side pressure drop (Δp), theoretical fan power (P), and heat transfer amount (Q), as represented by Equations [1] to [3] below. In addition, the log mean temperature difference (LMTD) and heat transfer coefficient (U) are evaluated to understand the effect of the oblique tubes 112 and corrugated fins on the air-side heat transfer performance, as represented by Equations [4] and [5] below.

$$\Delta p = p_{inlet} - p_{outlet} \quad \text{Equation [1]}$$

$$P = \frac{m_{air}}{\rho_{air}} \cdot \Delta p \quad \text{Equation [2]}$$

$$Q = m_{air} \cdot c_{p_air} \cdot (T_{air_outlet} - T_{air_inlet}) \quad \text{Equation [3]}$$

$$LMTD = \frac{(T_{wall_condensation} - T_{air_inlet}) - (T_{wall_condensation} - T_{air_outlet})}{\ln(T_{wall_condensation} - T_{air_inlet}) - \ln(T_{wall_condensation} - T_{air_outlet})} \quad \text{Equation [4]}$$

$$U = \frac{Q}{A_{heat_transfer} \cdot LMTD} \quad \text{Equation [5]}$$

$p_{inlet}$ represents the mean inlet air pressure (Pa); $p_{outlet}$ represents the mean outlet air pressure (Pa); $m_{air}$ represents the mass flow rate of air (kg/s); $\rho_{air}$ represents the mean air density (kg/m$^3$); $c_{p_air}$ represents the mean specific heat capacity of air (J/kgK); $T_{air_inlet}$ represents the mean inlet air temperature (K); $T_{air_outlet}$ represents the mean outlet air temperature (K); $T_{wall_condensation}$ represents the constant refrigerant condensation temperature (45° C.) at the internal wall of the tube; and $A_{heat_transfer}$ represents the total heat transfer area (m$^2$).

Figure 8B:
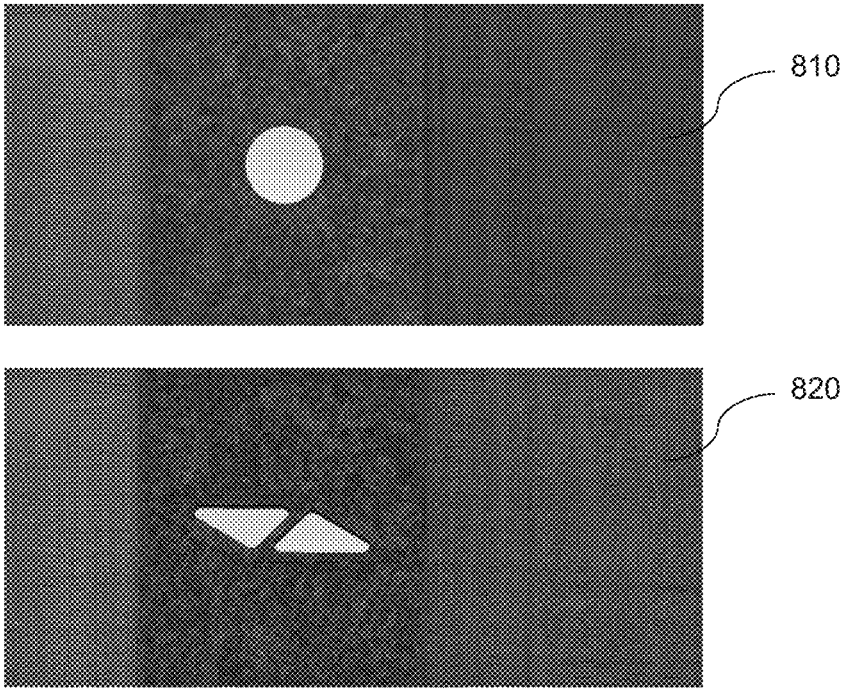

Grid independence assessment was conducted by comparing U and Δp for the PFCT and PFOT design models with 3 grid systems of increasing element numbers as shown in Table 800 in FIG. 8A. As shown in the numerical results of this study in Table 800, for the PFCT model, the difference in U and Δp between the grid systems with approximately 3.3 million and 10 million elements was less than 0.3%. For the PFOT model, the difference in U and Δp between the grid systems with approximately 2.9 million and 9.5 million elements was less than 1.8%. As such, it was considered practically acceptable to adopt the grid system with approximately 2.9 to 3.3 million elements for this study. The computational domains were meshed with approximately 2.9 to 3.3 million elements to build the grid systems for the PFCT and PFOT models. FIG. 8B(a) shows the grid system 810 for the PFCT model, and FIG. 8B(b) shows the grid system 820 for the PFOT model. The element size in the fin domain is much smaller as compared to the pre-domain and post-domain.

Figure 8C:
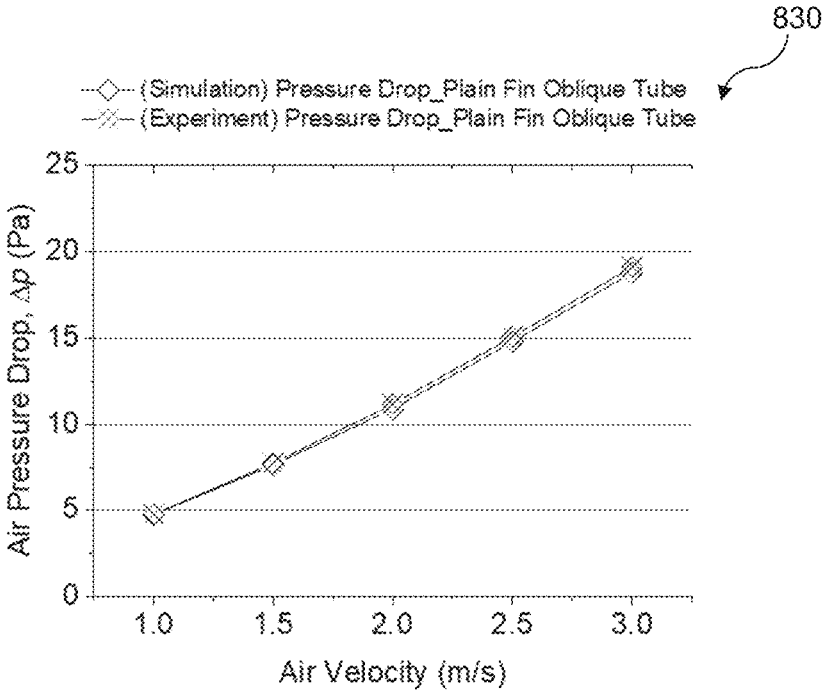

The numerical results of the air-side pressure drop for the PFOT model were compared against experimental results from a fabricated test coil based on the PFOT design. The air-side pressure drops were determined at inlet air velocities ranging from 1.0 m/s to 3.0 m/s. The test coil was tested in a recirculating wind tunnel with air flow and temperature control. A residential air conditioner was used to provide the refrigerant flow at saturation temperature into the test coil. Measurement of air-side pressure drop across the test coil by a differential pressure transducer at different inlet air velocities was used to measure the air-side pressure drop experimental results. Chart 830 in FIG. 8C shows the comparison between the numerical results and experimental results of the air-side pressure drop. The maximum deviation between the results was less than 2.5%. The experimental results thus correspond closely to the numerical results. As the flow between the fins is primarily characterised by the flow separation caused by the shape of the tube, the use of the realisable k-c turbulence model was validated by the experimental results.

Figure 9A:
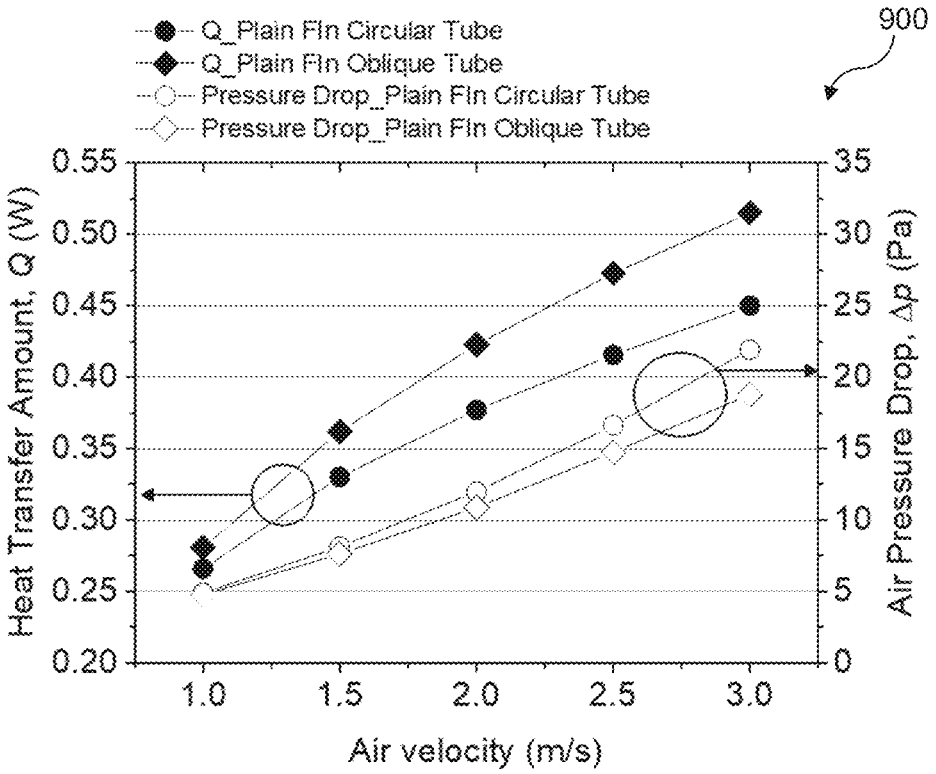
FIGS. 9A and 9B are illustrations of a numerical study to evaluate the heat transfer amount and air-side pressure drop of a plain-fin circular-tube model and a plain-fin oblique-tube model.

To study the effect of the oblique tubes 112 on the thermal-hydraulic performance of FTHXs, the numerical results of the heat transfer amount and air-side pressure drop for the PFCT and PFOT models were determined at inlet air velocities ranging from 1.0 m/s to 3.0 m/s. Chart 900 in FIG. 9A shows the comparison of the numerical results. For oblique tubes 112 with same internal area as the circular tubes, the heat transfer amount increased by 5.6% to 14.4% while the air-side pressure drop reduced by 2.7% to 14.4% at the same inlet air velocity. By using oblique tubes 112, the heat transfer amount can be improved even with lower air-side pressure drop.

Figure 9B:
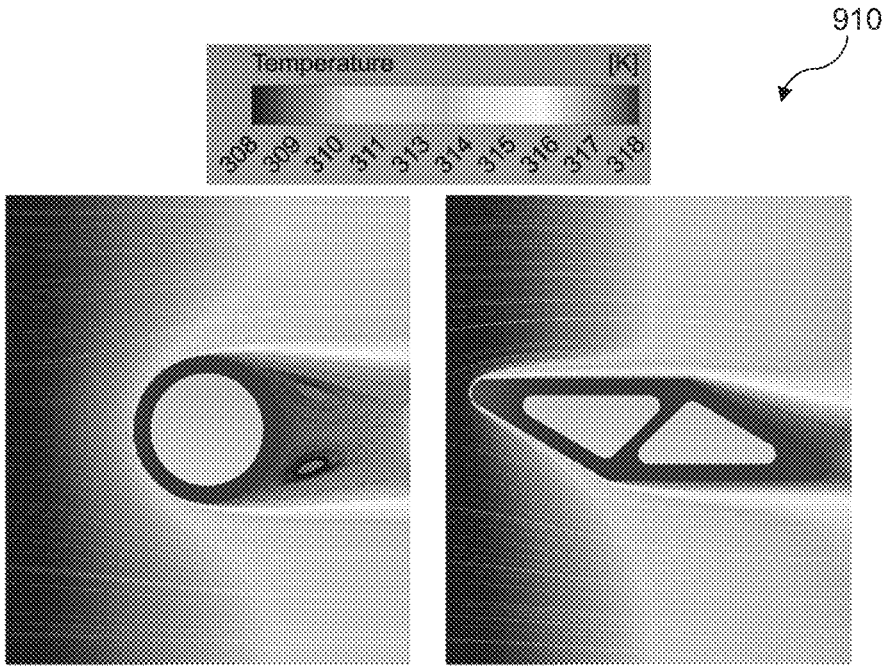

Images 910 in FIG. 9B show the temperature contour and velocity streamline at the middle plane of the computational domain of the respective tubes of the PFCT and PFOT models at an inlet air velocity of 2.0 m/s. It was observed that there was a smaller recirculation zone behind the tube, thus lower form drag. It was also observed that there was a less abrupt change of direction of the air flow streamlines for the PFOT model, thus lower pressure drop. For effective heat transfer between the FTHX with the air flow, a higher temperature gradient and a higher air flow velocity at most of the fin area are desired. Although the average air flow velocity in the PFOT model was lower than in the PFCT model, the heat transfer amount was still higher as there was more fin area with higher air flow velocity for effective heat transfer. For example, at the inlet air velocity of 2.0 m/s, the percentage of air flow region with velocities lower than 0.5 m/s for the PFOT model was just 3.5%, while it was 10.7% for the PFCT model, thus resulting in higher heat transfer amount for the PFOT model.

Figure 10A:
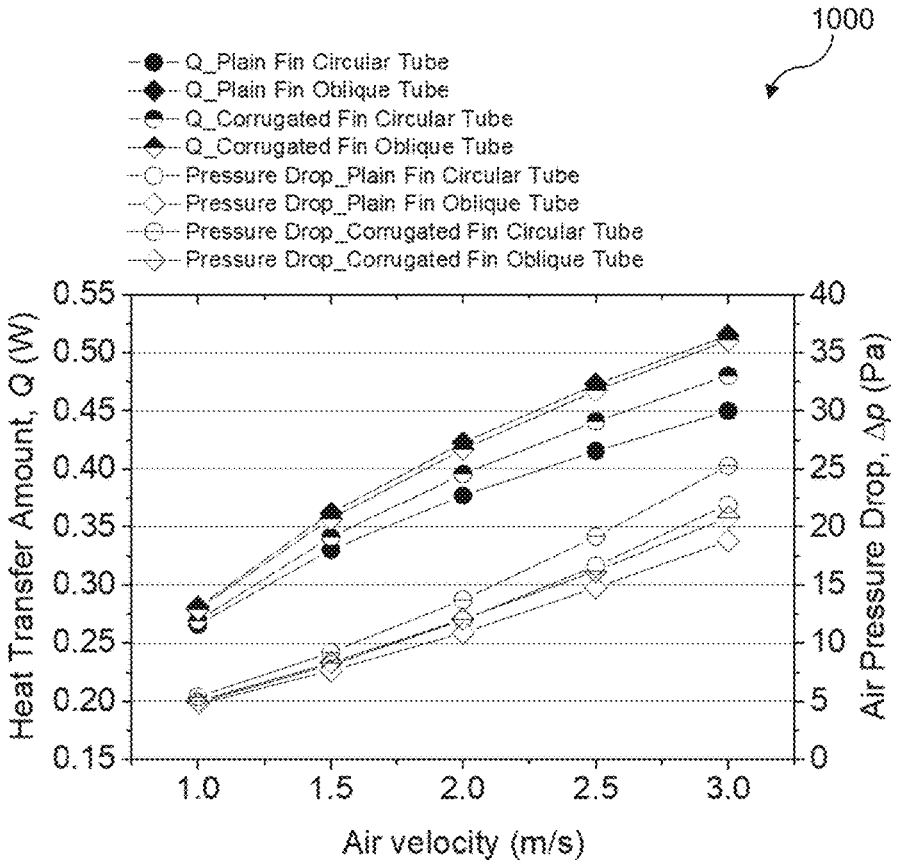
FIGS. 10A to 10D are illustrations of a numerical study to evaluate the thermal-hydraulic performance of a plain-fin circular-tube model, a plain-fin oblique-tube model, a corrugated-fin circular-tube model, and a corrugated-fin oblique-tube model.

The CFCT design commonly applied to household AC was used as the baseline for comparison with the other 3 designs. The numerical results of the heat transfer amount and air-side pressure drop for all 4 designs were determined at inlet air velocities ranging from 1.0 m/s to 3.0 m/s. Chart 1000 in FIG. 10A shows the comparison of the numerical results. For the PFCT and CFCT designs, the corrugated fin was found to improve the heat transfer amount of the circular tube by 1.3% to 6.7% at a higher air-side pressure drop of 9.9% to 15.4%. However, for the CFOT design, the heat transfer amount decreased slightly and the air-side pressure drop increased up to 10.7% compared to PFOT design. Use of corrugated fins is thus detrimental to the overall performance of FTHXs with oblique tubes 112.

Figure 10B:
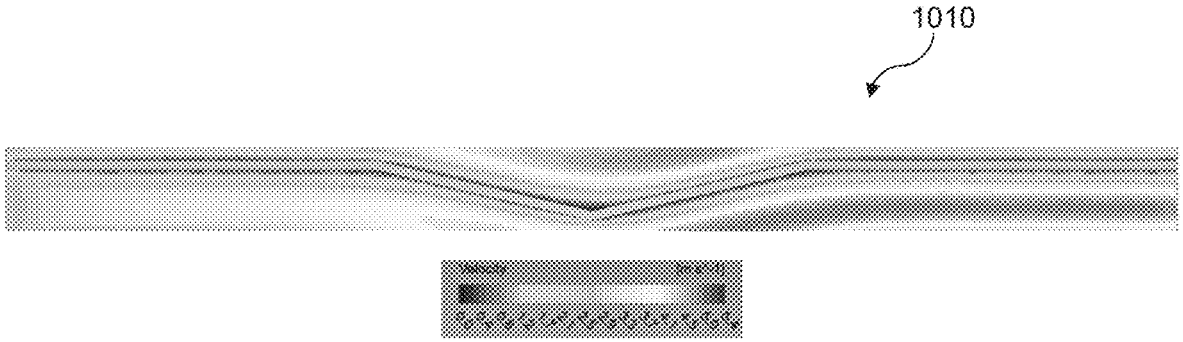

Image 1010 in FIG. 10B shows the cross-sectional plane velocity contour of the corrugated fin. It was observed that the air flow was redirected according to the contour of the corrugated fin, increasing the maximum air flow velocity by 5.1% and 5.8% for the CFCT and CFOT designs as compared to the PFCT and PFOT designs, respectively. More air flow separation zones were also present, of which 12.8% of the air flow region in the CFCT design and 7.8% in the CFOT design have air velocities lower than 0.5 m/s. The combined effects of higher air flow velocities but smaller effective heat transfer area due to flow separation make the corrugated fin design beneficial for circular tube but detrimental for oblique tube 112. Based on the comparison results of all 4 designs in Chart 1000, the PFOT design has the best overall performance with about 7% higher heat transfer amount and 11.5% to 25.8% lower air-side pressure drop than the baseline CFCT design.

Figure 10C:
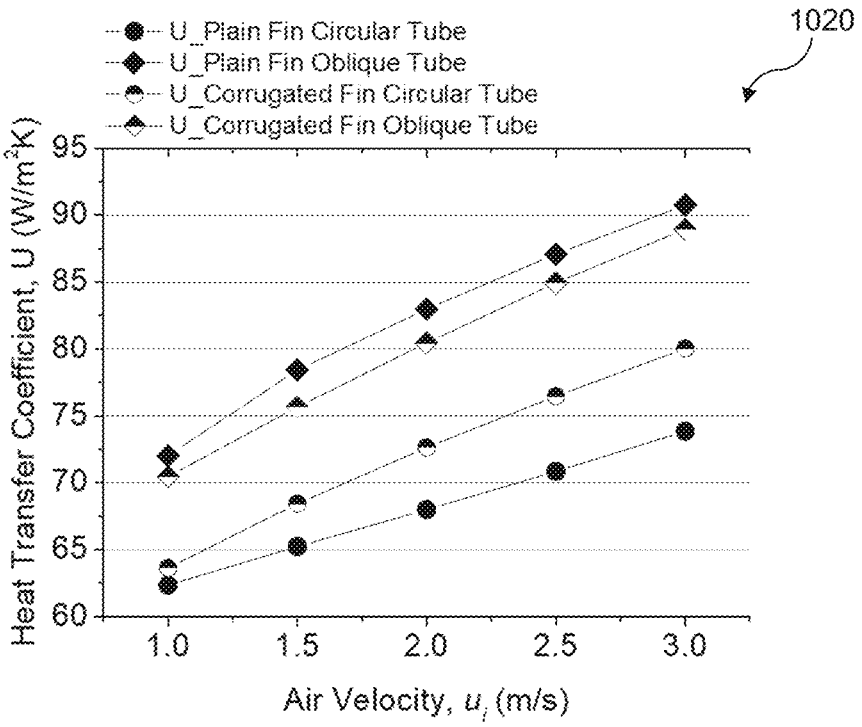
Figure 10D:
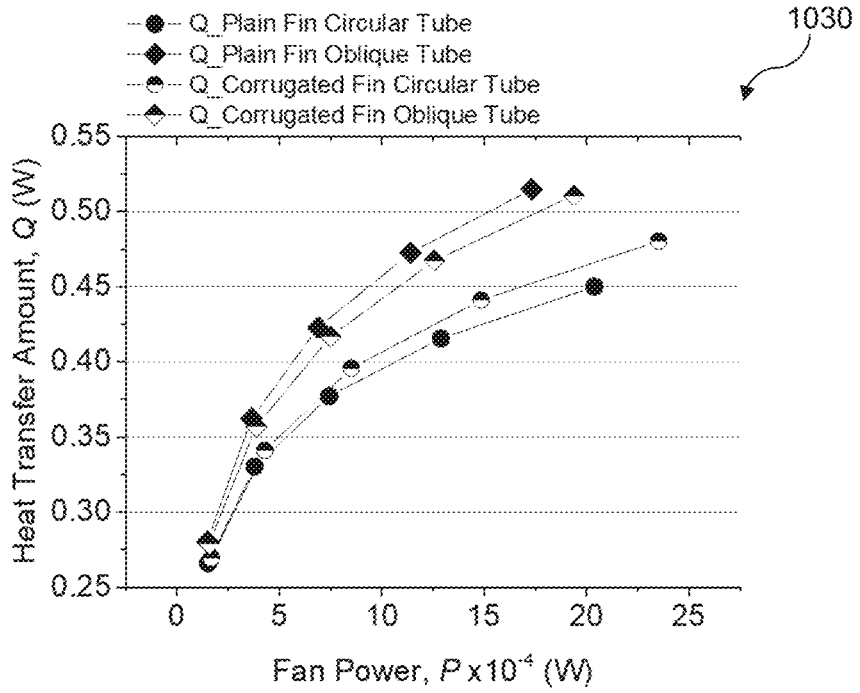

In addition to the total heat transfer amount and air-side pressure drop parameters for comparison of different FTHX designs, the heat transfer coefficient U, which is normalised by total heat transfer area and LMTD, is another parameter indicating the heat transfer rate of the FTHX design. Chart 1020 in FIG. 10C shows the heat transfer coefficients for all 4 designs. For the PFOT design, the heat transfer coefficient was about 12% higher than for the CFCT design. Even though the corrugated fin is detrimental to the heat transfer coefficient of the CFCT and CFOT designs, the heat transfer coefficient for the CFCT design was about 8% higher than for the PFCT design. For application of the designs to household AC, the heat transfer capacity of the design was compared at the same fan power, as shown in Chart 1030 in FIG. 10D. At the same fan power, the heat transfer capacity for the PFOT design was about 12% higher than for the CFCT design. For the CFCT design, the corrugated fin improved the heat transfer amount by 6.7% at the same inlet air velocity as compared to the PFCT design. However, when compared at the same fan power, the improvement was only 2.5% due to a higher air-side pressure drop. Higher heat transfer capacity achieved by the PFOT design at the same fan power would reduce the refrigerant condensation temperature and pressure, resulting in lower compressor lift and power consumption, and consequently higher coefficient of performance (COP) of the AC with the PFOT design applied thereto.

Therefore, in various embodiments of the present disclosure, the heat exchanger 50 and heat exchange unit 100 including the plain fins 102 and oblique tubes 112 based on the PFOT design have advantages over other designs as shown by the numerical and experimental results above. Comparing to existing FTHXs such as a commercial 1-row circular-tube condenser coil with corrugated fins (CFCT design), the results showed that the heat transfer amount increased by 5.6% to 14.4% while the air-side pressure drop reduced by 2.7% to 14.4% at the same inlet air velocity. The heat exchange unit 100 significantly reduces the air-side pressure drop due to the slender streamline profile of the oblique tubes 112. The slender streamline profile reduces air flow obstruction or resistance to the passage of air, and also reduces the degree of air flow separation and the wake zones behind the oblique tubes 112. This results in higher temperature gradients and higher heat transfer amount behind the oblique tubes 112. The heat exchange unit 100 is also able to achieve higher heat transfer capacity at the same fan power. As a result, the condensation temperature can be lower, reducing the power required for communication of air through the heat exchange unit 100. The power required to operate the heat exchanger 50/heat exchange unit 100 can thus be lower with the same fan size. Alternatively, the fan size can be reduced with the same heat transfer capacity.

In existing FTHXs such as outdoor condensing units or air handling units, there is high power consumption due to large fan sizes which are required to overcome static air pressure drop due to multiple circular tubes and corrugated fins, as well as other components such as HEPA filters. Heat exchange units 100 or heat exchangers 50 using the heat exchange units 100 that achieves lower air-side pressure drop would be desirable. At least two desirable scenarios can be obtained depending on operational requirements/applications of the heat exchanger 50/heat exchange unit 100. A first scenario is that when the air velocity is maintained at a constant, the air-side pressure drop is significantly reduced, thus reducing the overall system power consumption or allowing the use of a smaller fan size. A second scenario is that when the same fan size and power are fixed, higher heat transfer capacity can be achieved as compared to FTHXs of other designs.

The heat exchange unit 100 may be used to form or assemble large scale heat exchangers 50 that use a large number of oblique tubes 112, such as in a tube bank. Some commercial applications of the heat exchange unit 100 may be, but are not limited to, an air-cooled heat exchanger 50 for energy-efficient AC and refrigeration applications. For example, the heat exchanger 50/heat exchange unit 100 can be used in in residential and building AC systems for AC outdoor units and air handing units, as well as in cooling systems for data centres.

Various parameters of the heat exchange unit 100 may be further optimised to improve its performance, such as the materials and certain dimensions of the plain fins 102 and oblique tubes 112.

Figures 11A, 11B:
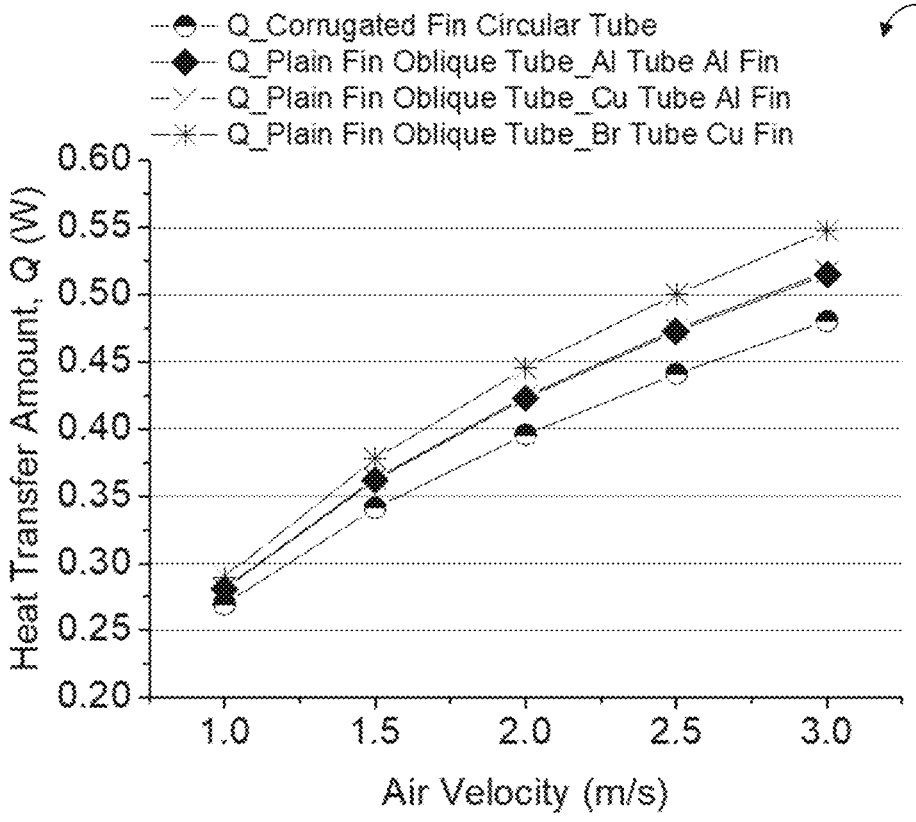
FIGS. 11A and 11B are illustrations of a numerical study to evaluate the heat transfer amount of a plain-fin circular-tube model, a plain-fin oblique-tube model, a corrugated-fin circular-tube model, and a corrugated-fin oblique-tube model.

In a typical CFCT-design FTHX for household AC, the circular tubes are made of copper and the fins are made of aluminium. Based on the von Mises stress analysis above, copper may not be a suitable material for the oblique tubes 112 due to its low yield strength relative to the maximum stress in the internal edges of the oblique tubes 112 under high refrigerant pressure. Copper may still be considered suitable if the oblique tubes 112 are appropriately designed, such as with appropriate internal ribs 120 and tube wall thickness. Alternatively, aluminium would be a suitable material for the plain fins 102 and oblique tubes 112 as it is able to withstand the high refrigerant pressure. The CAB process is suitable for joining the plain fins 102 and oblique tubes 112 made of the same aluminium material. Another possible material may be brass which has a yield strength of approximately 200 MPa. For example, the oblique tubes 112 may be made of brass and the plain fins 102 may be made of copper. The mechanical and thermal properties of copper, aluminium, and brass are shown in Table 1100 in FIG. 11A.

Various models of the PFOT design were built and evaluated against the CFCT model (Al-fin-Cu-tube). The PFOT models included one with aluminium fins and copper tubes (Al-fin-Cu-tube), one with aluminium fins and tubes (Al-fin-Al-tube), and one with copper fins and brass tubes (Cu-fin-Br-tube). The heat transfer performances of these models at inlet air velocities ranging from 1.0 m/s to 3.0 m/s are shown in Chart 1110 in FIG. 11B. The difference in performances of the Al-fin-Cu-tube PFOT model and Al-fin-Al-tube PFOT model was negligible. This means that the influence of the material of the oblique tubes 112 was negligible, likely due to the small wall thickness of the oblique tubes 112. The Cu-fin-Br-tube PFOT model achieved up to 6.3% higher heat transfer than the Al-fin-Al-tube PFOT model, and up to 14% higher than the Al-fin-Cu-tube CFCT model. Although the use of copper fins improved the heat transfer performance compared to other models, the Al-fin-Al-tube PFOT model also achieved better performance than the existing CFCT model, and the Al-fin-Al-tube PFOT model is lighter and cheaper in material cost compared to the Cu-fin-Br-tube PFOT model. The Al-fin-Al-tube PFOT model would be a suitable design for heat exchangers 50/heat exchange units 100 for use as condenser coils in household AC. However, when high heat transfer performance is required of a heat exchanger 50/heat exchange unit 100, the Cu-fin-Br-tube PFOT model may be more suitable as it achieved the best heat transfer performance as shown in Chart 1110. The Al-fin-Al-tube PFOT model would be used for further evaluation of optimal parameters thereof.

Figure 12:
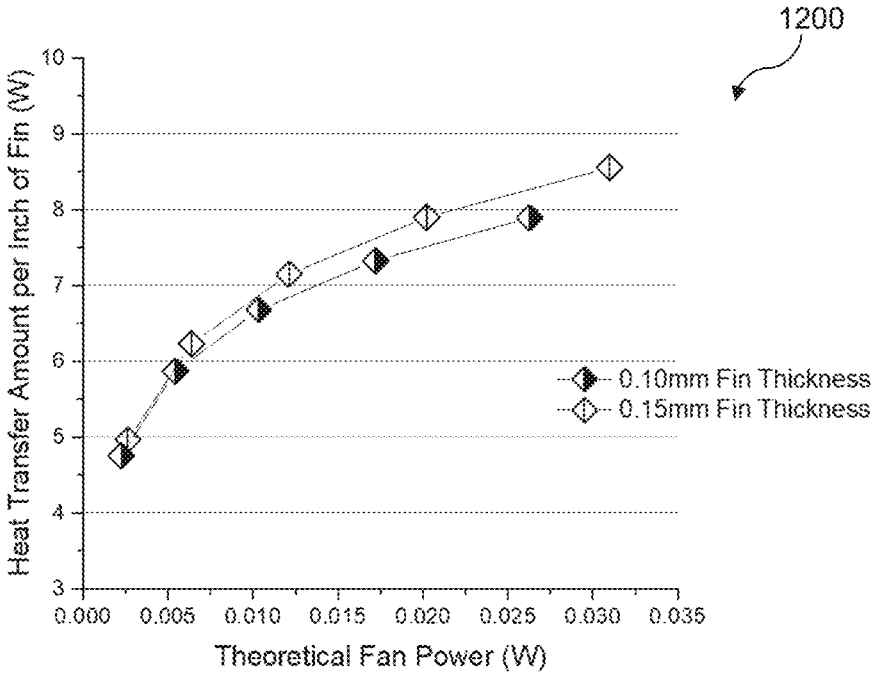
FIG. 12 is an illustration of a numerical study to evaluate the heat transfer amount of plain-fin oblique-tube models with different fin thickness.

In a typical CFCT-design FTHX for household AC, common thicknesses of the aluminium fins are 0.10 mm and 0.15 mm. An FTHX using 0.10 mm aluminium fins instead of 0.15 mm would reduce about 50% of material and would be about 50% lighter. A disadvantage of thinner fins is that the structural strength of the FTHX is reduced and the FTHX would be more susceptible to damage during handling and maintenance of the FTHX. Two PFOT models—one having 0.10 mm thick plain fins 102 and the other having 0.15 mm thick plain fins 102—were built and evaluated against each other. The fin pitch was maintained at 1.4 mm for both models. As such, the 0.10 mm model had a fin-to-fin gap of 1.3 mm and the 0.15 mm model had a fin-to-fin gap of 1.25 mm. The thermal or heat transfer performances of these models at a range of theoretical fan powers are shown in Chart 1200 in FIG. 12. For the same fan power or inlet air velocity, a smaller fin-to-fin gap would lead to higher air flow velocity across the fin surfaces, resulting in higher heat transfer amount and higher air-side pressure drop. The increase in air flow velocity would increase the surface friction. The results in Chart 1200 show that the heat transfer amount for the 0.15 mm model was about 6% higher than the 0.10 mm model. The increase in surface friction was insignificant when compared at the same fan power as the 0.15 mm model still achieved better heat transfer performance than the 0.10 mm model. However, as the improvement in heat transfer performance was not significant and in addition to considerations of material cost and weight reductions, 0.10 mm thick plain fins 102 would be more suitable for the Al-fin-Al-tube PFOT model.

Figure 13A:
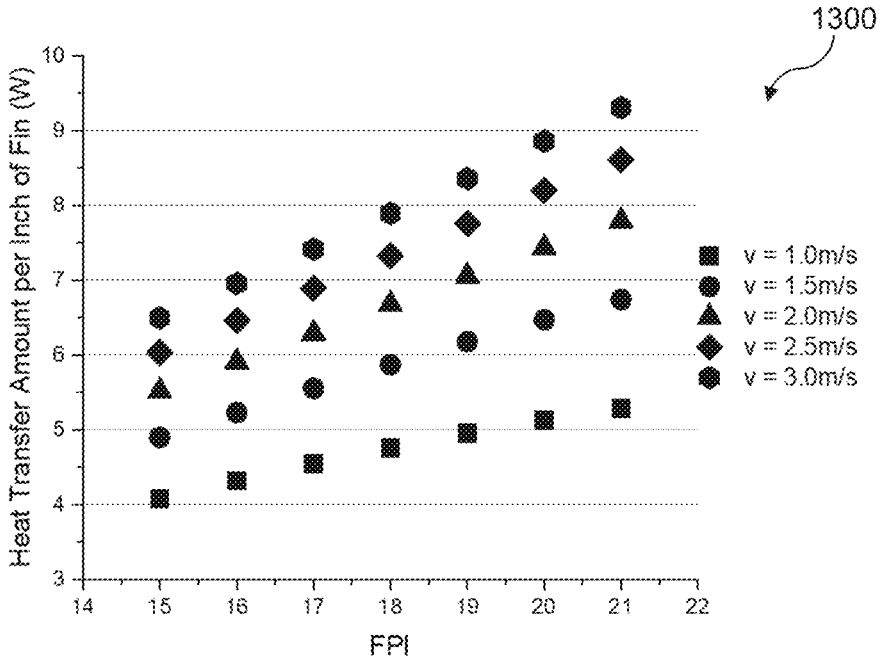
FIGS. 13A and 13B are illustrations of a numerical study to evaluate the heat transfer amount of plain-fin oblique-tube models with different number of fins per inch.
Figure 13B:
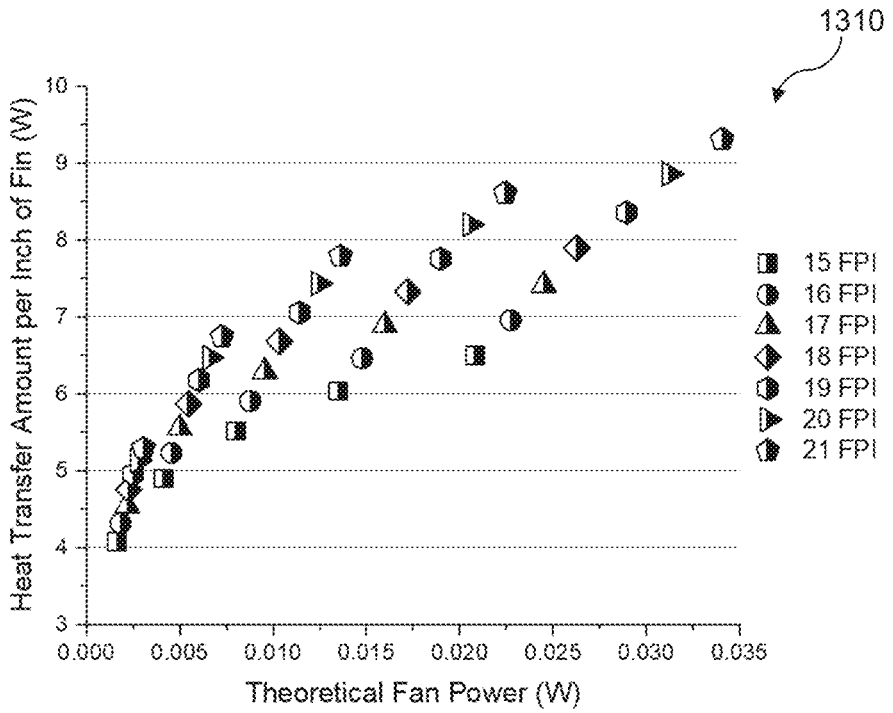

Another parameter of FTHXs is the FPI which refers to the number of fins per inch. The FPI relates to the density of the fins in the FTHXs and commonly range from 15 to 21. Various PFOT models with different FPIs were built and evaluated against one another. The heat transfer performances of these models at inlet air velocities ranging from 1.0 m/s to 3.0 m/s are shown in Chart 1300 in FIG. 13A. The heat transfer performances of these models at different theoretical fan powers are shown in Chart 1310 in FIG. 13B. The results show that higher FPI leads to higher heat transfer performance as there is more fin area for heat transfer. Additionally, the heat transfer amount of a model with higher FPI at a certain fan power or inlet air velocity is significantly higher than another model with lower FPI but higher fan power. For example, the model with 21 FPI at 2.0 m/s air velocity consumed the same amount of fan power, but achieved over 30% higher heat transfer amount than the model with 15 FPI at 2.5 m/s air velocity. The results show that the FPI parameter is a more important factor in thermal performance than inlet air velocity or fan power. A high performance heat exchange unit 100 may have a high FPI and a small air velocity may be used to achieve high thermal performance without significant air-side pressure drop penalty. However, the material cost and weight of the heat exchange unit 100 would be higher too. The appropriate FPI of the heat exchange unit 100 would depend on the applications of the heat exchange unit 100 or the heat exchanger 50 using it, considering the thermal requirement of the applications and the material cost.

Figure 14A:
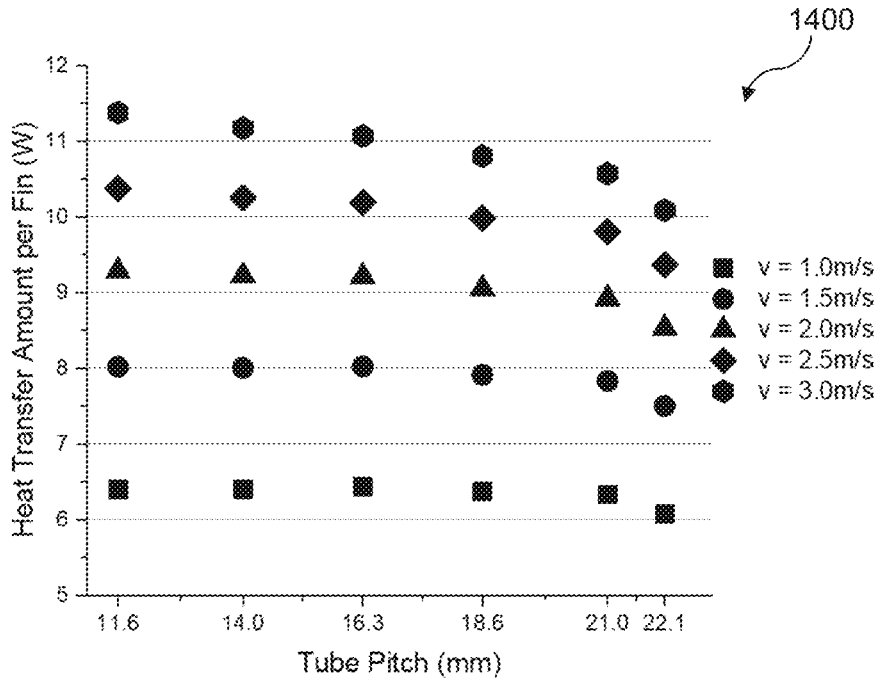
FIGS. 14A and 14B are illustrations of a numerical study to evaluate the heat transfer amount of plain-fin oblique-tube models with different fin pitch.
Figure 14B:
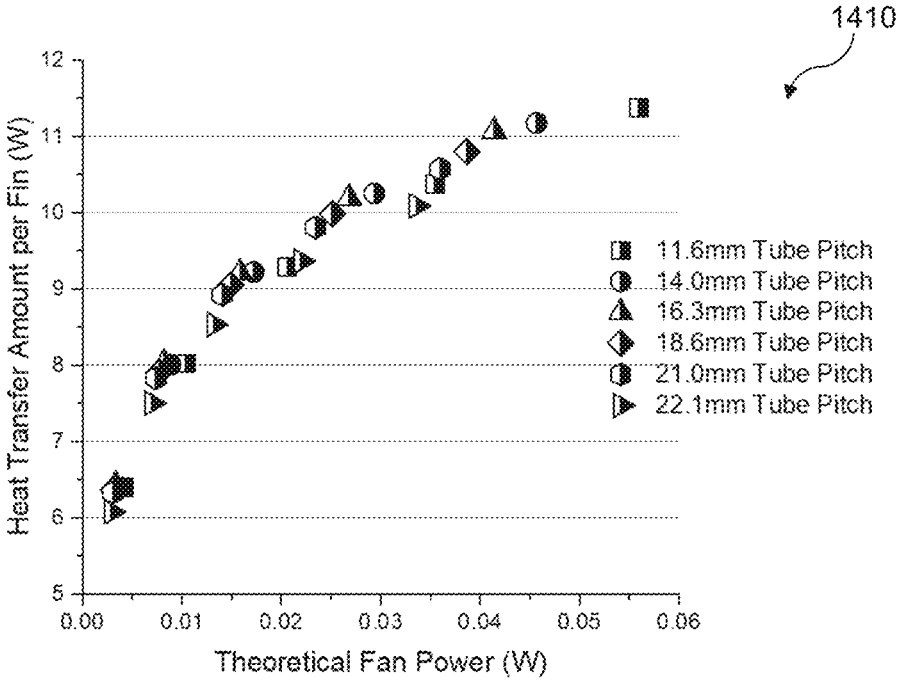

Another parameter of FTHXs is the tube pitch which refers to the distance between the oblique tubes 112. Various PFOT models with 18 FPI but different tube pitches were built and evaluated against one another. The tube pitch of the models ranges from 11.6 mm to 22.1 mm which is equivalent to approximately 2.5 to 4.5 times the projected width of the oblique tube 112 on the first plane. The thermal-hydraulic performance of the models was calculated for per fin length of 527 mm based on the size of an actual condenser coil because each model was built with different tube pitch, thus having different fin size and area. The heat transfer performances of these models at inlet air velocities ranging from 1.0 m/s to 3.0 m/s are shown in Chart 1400 in FIG. 14A. The heat transfer performances of these models at different theoretical fan powers are shown in Chart 1410 in FIG. 14B. The effect of tube pitch on the total heat transfer amount per fin length of 527 mm was negligible as the total fin area was similar. Smaller tube pitch means there are more tubes per fin, but since the tube heat transfer area is small compared to the fin area, the drop in heat transfer amount is gradual when the tube pitch increases, as shown in Chart 1400. Referring to Chart 1410, at tube pitches of 14 mm and 16.3 mm which are equivalent to approximately 3 to 3.5 times the tube projected width, an exponentially decreasing trend showing the flattening of heat transfer amount per fin when the fan power increases was observed. Further increase in fan power did not result in better heat transfer performance. For same-sized heat exchange units 100, one with 16.3 mm tube pitch has fewer oblique tubes 112 than one with 14 mm tube pitch, both achieving similar heat transfer performance. Thus, the optimal tube pitch would be 16.3 mm which is equivalent to approximately 3.5 times of the tube projected width. This optimal tube pitch to tube projected width ratio is close to the 3.2 ratio for the existing CFCT design which has a tube pitch of 22.1 mm and a tube projected width of 6.82 mm.

The above-described parameters optimisation to improve performance of the heat exchange unit 100 show that under steady-state operation conditions, the effect of tube material on the thermal performance of the heat exchange unit 100 is insignificant. The plain fins 102 and oblique tubes 112 can be made of an aluminium material, although copper fins may be more suitable for high performance. The selection of fin thickness, FPI, and tube pitch depends on the application of the heat exchange unit 100. Various factors such as heat transfer requirement, weight of the heat exchange unit 100, and overall material cost constraint should be considered for the application. Based on the results above, there is no optimal FPI, the optimal fin thickness is 0.10 mm, and the optimal tube pitch is 16.3 mm to keep the tube pitch to tube projected width ratio to between 3 and 3.5 for optimal heat transfer at a given inlet air velocity.

As described above, the heat exchanger 50 having the heat exchange unit 100 or PFOT coil can be designed and formed with different number of tubes per pass, namely the heat exchangers 202, 204, 206, 208, 210, 212, and 214 shown in FIGS. 2(*a*) to 2(*g*). The heat exchangers 202 to 214 have 1-tube-per-pass, 2-tubes-per-pass, 3-tubes-per-pass, 4-tubes-per-pass, 5-tubes-per-pass, 7-tubes-per-pass and 14-tubes-per-pass PFOT coil designs, respectively. The number of tubes per pass are designed based on the number and arrangement of baffles 118 in the headers 116. Various experiments were performed to compare the thermal-hydraulic performance of the heat exchangers 202 to 214 against the reference heat exchanger 216 which is based on an existing CFCT-design FTHX. These experiments were performed in a recirculating wind tunnel having a 300 mm by 300 mm test section.

Each of the heat exchangers 202 to 214 was designed to a size of approximately 300 mm by 300 mm matching the dimensions of the wind tunnel test section. Each plain fin 102 has a 300 mm length and a 19 mm width, and has 14 oblique holes 122 wherethrough 14 oblique tubes 112 are inserted. The distance between adjacent holes 122, i.e. the tube pitch, is 22.1 mm. The thickness of each plain fin 102 is 0.10 mm and the fin pitch is 1.4 mm. The wall thickness of the oblique tubes 112 is 0.6 mm. The reference heat exchanger 216 has circular tubes with a tube diameter of 6.35 mm, resulting in the same internal tube area as the oblique tubes 112. The reference heat exchanger 216 also has the same tube pitch, fin thickness, and fin pitch as the other heat exchangers 202 to 214.

The wind tunnel is made of thermally insulating acrylic walls and produced air at a controlled temperature of 30° C. and at inlet air velocities ranging from 1.0 m/s to 3.0 m/s. Each of the heat exchangers 202-216 is connected to a water circulation system to distribute heated water through the heat exchangers 202-216. The first fluid 104 is thus the air generated by the wind tunnel and the second fluid 110 is the heated water. The water circulation system includes a water bath for maintaining the heated water at a temperature of 45±0.04° C., and a water pump for pumping the heated water into the inlet 106 and returning the water from the outlet 108 to the water bath. A flow meter measured flow rates of the water as 1.7 to 2.8 litres per minute (L/min). A data acquisition (DAQ) system was installed for measuring the air-side and water-side pressure and temperature and for capturing thermal images of the tube coil surfaces. An infrared camera placed on a moveable platform was also used to thermally visualise the tube coil surface temperature.

The infrared camera has a reading accuracy of 2% for the measuring temperature range of −40° C. to 150° C.

Multiple resistance temperature detectors (RTDs) and pressure transducers were installed before and after the tube coils for monitoring the water-side temperature difference, water-side pressure drop, air-side pressure drop, and heat transfer capacity of the tube coils. The accuracy of each RTD is ±0.05° C. and the accuracy of each pressure transducer is of ±0.5%. A hot-wire probe with an accuracy of ±2.8-4.5% was used to measure inlet air velocity. The difference between the average inlet and outlet air temperatures measured from the RTDs provided the air-side temperature difference to obtain the heat transfer capacity.

The heat transfer capacity of a tube coil can be obtained either from the water-side heat transfer amount or the air-side one heat transfer amount. The heat transfer amounts represent the thermal performance of the tube coil which is for air-cooling of the water. The water-side heat transfer amount represents the amount of heat removed from the water by the air, and the air-side heat transfer amount represents the amount of heat received by the air from the water. The water-side heat transfer amount ($Q_{water}$) and air-side heat transfer amount ($Q_{air}$) are represented by Equations [6] and [7] below.

$$Q_{water}=m_{water}\cdot c_{p_water}\cdot(T_{water_outlet}-T_{water_inlet}) \quad \text{Equation [6]}$$

$$Q_{air}=m_{air}\cdot c_{p_air}\cdot(T_{air_outlet}-T_{air_inlet}) \quad \text{Equation [7]}$$

$m_{water}$ and $m_{air}$ represent the mass flow rate of water and air, respectively; $c_{p_water}$ and $c_{p_air}$ represent the mean specific heat capacities of water and air, respectively; $T_{water_outlet}-T_{water_inlet}$ represents the water-side temperature difference between the inlet 106 and outlet 108; and $T_{air_outlet}-T_{air_inlet}$ represents the air-side temperature difference across the tube coil.

On the water side, although Equation [6] suggests that the higher mass flow results in the higher heat transfer amount, there is a penalty of increased water-side pressure drop across the tube coil ($p_{water}$). The requirement of water pump power will adversely be higher water, to mitigate this penalty. In addition, the air-side heat transfer capacity should be compared at the same fan power input. The water pump power ($P_{pump}$) and fan power input ($P_{fan}$) are represented by Equations [8] and [9] below.

$$P_{pump}=q_{water}\cdot\Delta p_{water} \quad \text{Equation [8]}$$

$$P_{fan}=V\cdot A\cdot\Delta p_{air} \quad \text{Equation [9]}$$

$q_{water}$ represents the water flow rate; $\Delta p_{water}$ and $\Delta p_{air}$ represent the water-side and air-side pressure difference, respectively; V represents the mean inlet air velocity; and A represents the cross-sectional area of the wind tunnel test section.

The wind tunnel was calibrated prior to the experiments to evaluate the performance of the heat exchangers 202-216. Velocity and temperature profiles of wind in the wind tunnel test section were calibrated with 50 measurement points (5 span-wise points, each of which has 10 longitudinal points). Since the oblique-tube coils (heat exchangers 202 to 214) circular-tube coil (heat exchanger 216) have different fin designs, the calibrations were performed individually. The experiments were performed at inlet air velocities ranging from 1.0 m/s to 3.0 m/s.

Figure 15:
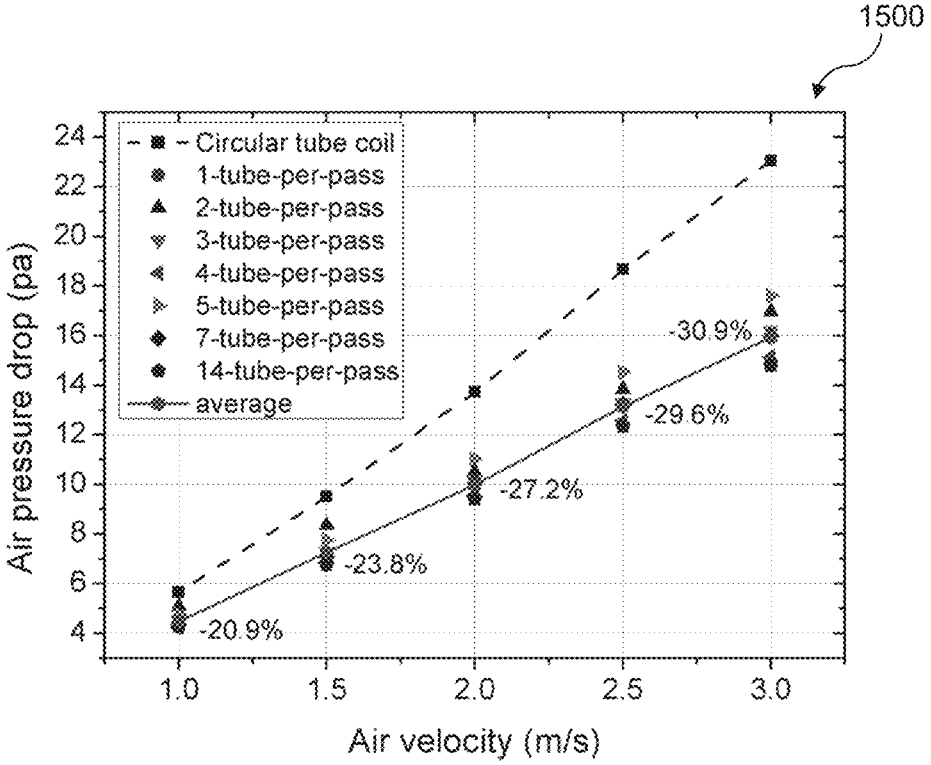
FIG. 15 is an illustration of an experiment to evaluate the air-side pressure drop of the heat exchangers of FIG. 2.

An experiment was performed to evaluate the air-side pressure drop of the heat exchangers 202-216. The inlet water temperature was maintained at 45° C., the water flow rate was minimally varied from 2.1 to 2.2 L/min, and the average inlet air temperature was 30° C. The experiment results are shown in Chart 1500 in FIG. 15. Although the oblique-tube heat exchangers 202 to 214 have different number of oblique tubes 112 per pass, the differences in air-side pressure drop were negligible in comparison to the difference with the air-side pressure drop of the circular-tube heat exchanger 216. Using oblique tubes 112 instead of circular tubes can reduce the air-side pressure drop by 20.9% to 30.9%. Although the circular-tube coil is commonly used in residential AC systems and is typically finned with corrugated fins for improved air-side heat transfer amount, this fin design to a certain extent adversely contributes to an increase of the air pressure drop, thus increasing the and fan power input to its AC system. The experiment results showed that the slender streamline profile of the oblique tubes 112 achieved significant reduction in air-side pressure drop compared to existing circular tubes.

An experiment was performed to evaluate the water-side heat transfer amount and water-side pressure drop of the heat exchangers 202-216. The experiment results on the heat transfer amount are shown in Chart 1600 in FIG. 16(*a*). Each data point on individual coil designs represents a fan power derived from the air velocity (i.e. 1, 1.5, 2, 2.5, and 3 m/s) and the corresponding air-side pressure drop. It can be seen from Chart 1600 that for the same fan power, the heat exchanger 202 (1-tube-per-pass PFOT) had the highest heat transfer amount and its performance surpassed the commercially-available heat exchanger 216 (CFCT). When the number of tubes per pass increased (heat exchangers 204-214) and non-uniform distribution of heated water into each oblique tube 112 occurred, the heat transfer amounts were reduced. The higher performance heat exchangers were the heat exchangers 202-208 (1-, 2-, 3-, and 4-tubes-per-pass PFOT designs) and the heat exchanger 216. The lower performance heat exchangers were the heat exchangers 208-212 (5-, 7-, and 14-tubes-per-pass PFOT). The heat exchangers 208 and 210 have similar thermal performance for almost the whole range of fan power as water was split in the middle of both PFOT coils, though the heat exchanger 208 eventually had higher thermal performance at higher fan power. The heat exchangers 208-212 reached their performance plateau at air velocity of 1.5 m/s to 2.0 m/s. As the maldistribution of thermal performance became more severe with increasing the number of oblique tubes 112 per pass, the water-side heat transfer could not be further improved with increasing fan power.

Figure 16:
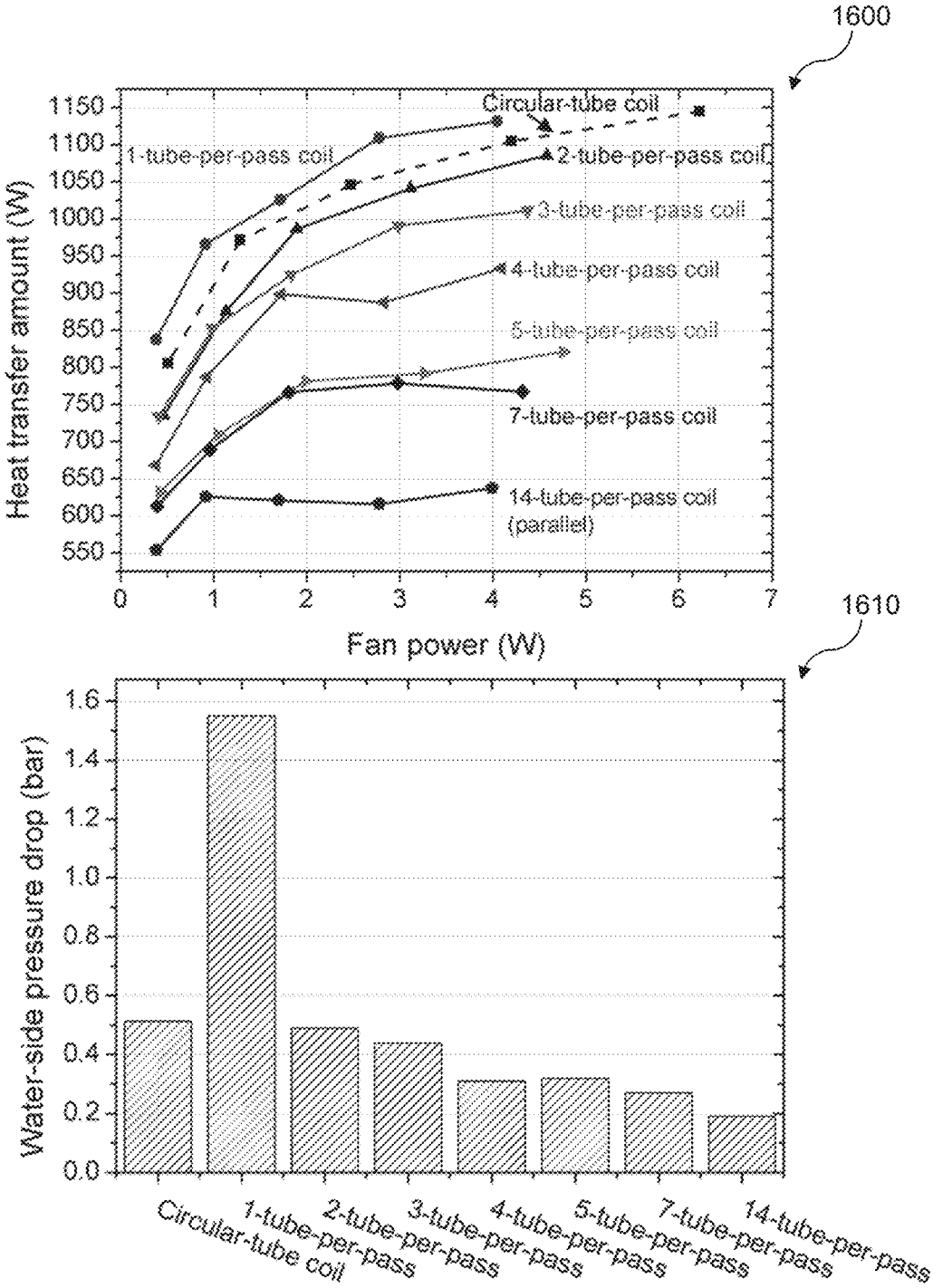
FIG. 16 is an illustration of an experiment to evaluate the heat transfer amount and water-side pressure drop of the heat exchangers of FIG. 2.

The experiment results on the water-side pressure drop are shown in Chart 1610 in FIG. 16(*b*). The water-side pressure drop is a factor in determining the water pump power required to operate the heat exchanger. Although the heat exchanger 202 had the highest heat transfer performance, the water-side pressure drop penalty was at least 3 times higher than the other heat exchangers 204-216 in the experiment. Since the heat exchanger 202 has only 1 oblique tube 112 per pass and the water flow rate was fixed, the water velocity in the oblique tubes 112 was significantly higher, resulting in the high water-side pressure drop penalty. Notably, the water-side pressure drop is dependent on the square of the water velocity.

Figure 17:
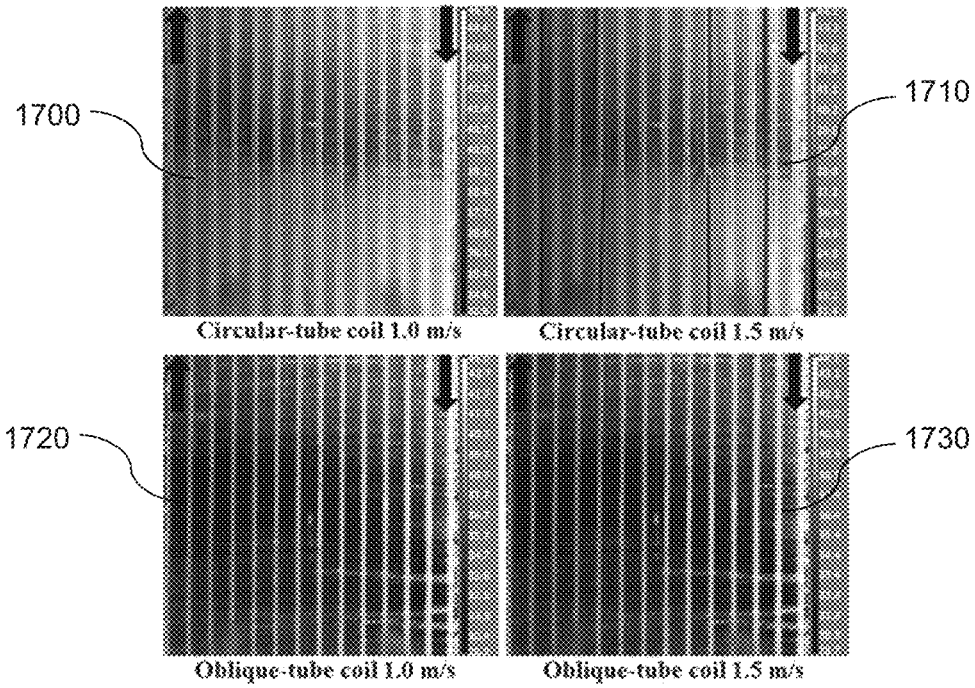
FIG. 17 is an illustration of an experiment to thermally visualise the fin surface temperature of the heat exchangers of FIG. 2.

An experiment was performed to thermally visualise the surface temperature of the fins of the heat exchangers 204 (2-tubes-per-pass PFOT) and 216 (CFCT) using the infrared camera. The thermal visualisations are shown in FIGS. 17(*a*) to 17(*d*). Images 1700 and 1710 show the thermal visualisations of the circular-tube coil at air velocity of 1.0 m/s and 1.5 m/s. Images 1720 and 1730 show the thermal visualisations of the 2-tubes-per-pass oblique-tube coil at air velocity of 1.0 m/s and 1.5 m/s. The arrows represent the flow directions of the heated water. The surface temperature of heated water entering the tube coil is always higher than that exiting, since the water is cooled by the air flow. When the air velocity increases from 1 m/s to 1.5 m/s, the surface temperatures surfaces of the circular-tube coil (Images 1700 and 1710) and oblique-tube coil (Images 1720 and 1730) reduced. This was due to the higher air flow rate which resulted in higher heat removal. In addition, the thermal visualisations showed that the surface temperatures of the oblique-tube coil at both air velocities were approximately 4% lower than that of the circular-tube coil.

Figure 18:
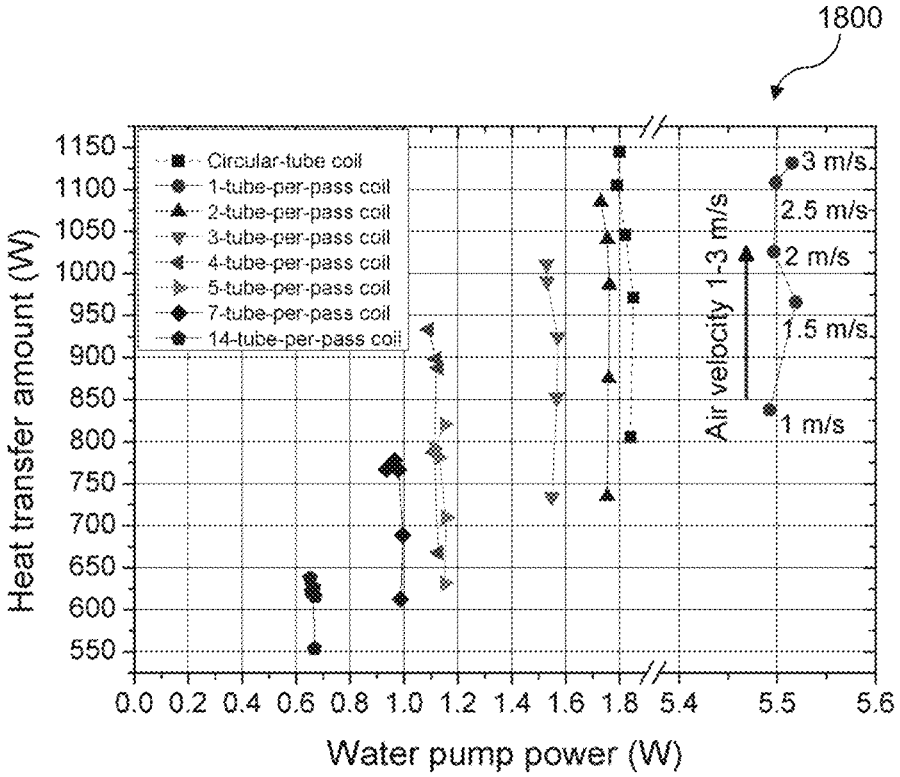
FIG. 18 is an illustration of an experiment to evaluate the heat transfer amount of the heat exchangers of FIG. 2 based on water pump power.

Charts 1600 and 1610 show that the heat exchanger 202 had high heat performance but also had the highest water-side pressure drop. An experiment was performed to evaluate the effect of water pump power on the heat transfer amount of the heat exchangers 202-216, the results of which may be useful in selection of a suitable oblique-tube coil design that is able to match the heat removal capacity of the circular-tube coil design. The water pump power was determined using Equation [8], the water flow rate was fixed at 2.13 L/min, and the water-side pressure drop records were as presented in Chart 1610. The experiment results on the water pump power and heat transfer amount are shown in Chart 1800 in FIG. 18. Chart 1800 shows that the heat exchanger 202 (1-tube-per-pass) was the only oblique-tube coil design that could match the heat removal capacity of the heat exchanger 216 (circular-tube) for the same air velocity. Although both coil designs provided the highest heat transfer performance, they suffered from the relatively high water pump power due to the significant water-side pressure drop.

While the water pump power could be reduced by increasing the number of tubes per pass in the oblique-tube coil design, the heat removal capacity would reduce too. For applications that require heat removal capacity similar to that of the circular-tube coil, either the heat exchanger 204 or 206 (2- or 3-tubes-per-pass PFOT) may be selected as both require lower water pump power and thus lower water power consumption. As for energy-saving applications, the heat exchanger 208 (4-tubes-per-pass PFOT) can be considered because it could save water pump power by as high as 27.9%, 36.3%, and 38.7% compared to the heat exchangers 206, 204, and 216 (3-tubes-per-pass PFOT, 2-tubes-per-pass PFOT, and CFCT), respectively. The effect of air velocity on the heat transfer performance may be considered during selection of the coil design. For example, the heat transfer amount of the heat exchanger 206 (3-tubes-per-pass PFOT) was approximately 990 W at air velocity of 2.5 m/s, comparable to the heat transfer amount of the heat exchanger 204 (2-tubes-per-pass PFOT) which was approximately 986 W at air velocity of 2.5 m/s.

Figure 19:
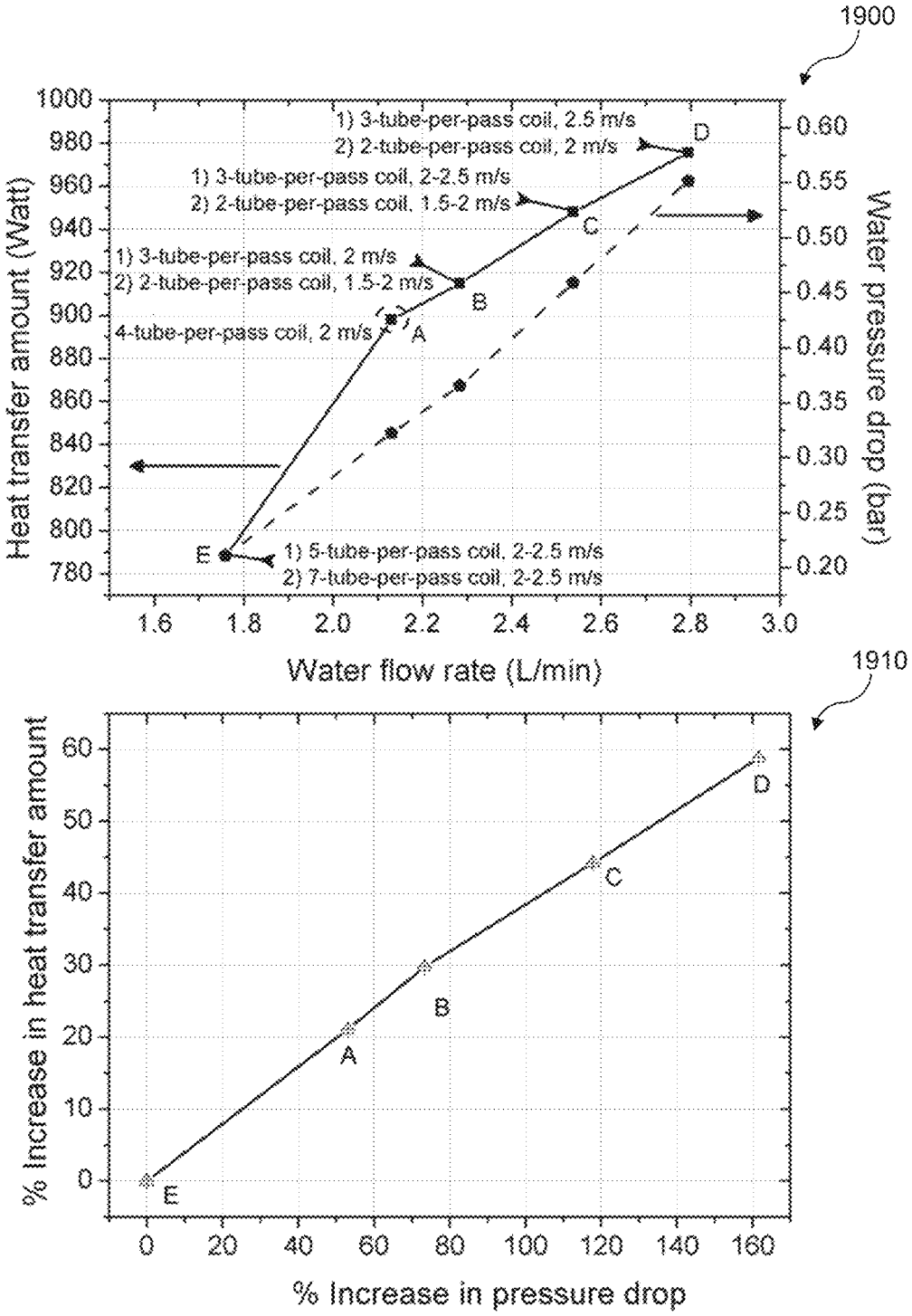
FIG. 19 is an illustration of an experiment to evaluate the heat transfer amount of the heat exchangers of FIG. 2 based on water flow rate.

An experiment was performed to evaluate the effect of water flow rate on the heat transfer amount of the heat exchangers 202-216. The heat transfer amount and water-side pressure drop were measured at water flow rates ranging from 1.7 to 2.8 L/min. The experiment results for the heat exchanger 208 (4-tubes-per-pass PFOT) are shown in Chart 1900 in FIG. 19(*a*). There was improvement of the heat transfer amount for the heat exchanger 208 with increasing water flow rates. Point A represents the heat transfer amount of 898 W at water flow rate of 2.13 L/min and air velocity of 2.0 m/s. From Points A to B, the water flow rate increased from 2.13 to 2.28 L/min, and the thermal performance increased as well. The thermal performance at Point B matched that of the heat exchanger 206 (3-tubes-per-pass PFOT) at air velocity of 2.0 m/s and also of the heat exchanger 204 (2-tubes-per-pass PFOT) at air velocity of 1.5 m/s to 2.0 m/s. Other possible thermal performance matchings are represented by Points C, D, and E. In addition, the experiment results in Chart 1900 were used to derive Chart 1910 in FIG. 19(*b*) which show the relationship between the percentage increase in heat transfer amount against the percentage increase in water-side pressure drop. The percentage changes were based on the respective data at Point E of Chart 1900.

The heat exchangers 202 to 214 having the oblique-tube coil design with various number of oblique tubes 112 per pass are designed based on the heat exchange unit 100 or the heat exchanger 50 having the heat exchange unit 100. Compared to an existing circular-tube coil design, the heat exchanger 50 achieved improved heat transfer performance with reduced air-side pressure drop penalties. The slender streamline profile of the oblique tubes 112 contributed to the reduced air-side pressure drop penalties of approximately 20.9% to 30.9% for air velocity ranging from 1.0 m/s to 3.0 m/s. Thermal performance of the 1-tube-per-pass oblique-tube coil surpassed that of the circular-tube coil albeit not energy-saving. On the other hand, the 2-, 3- and 4-tubes-per-pass oblique-tube coils were shown to provide similar heat transfer performance as the circular-tube coil with some energy savings. Depending on the operational requirements/applications of the heat exchanger 50, the number of oblique tubes 112 per pass may be varied to achieve different thermal-hydraulic performances.

In the foregoing detailed description, embodiments of the present disclosure in relation to a heat exchange unit for a heat exchanger and a method for manufacturing the heat exchange unit are described with reference to the provided figures. The description of the various embodiments herein is not intended to call out or be limited only to specific or particular representations of the present disclosure, but merely to illustrate non-limiting examples of the present disclosure. The present disclosure serves to address at least one of the mentioned problems and issues associated with the prior art. Although only some embodiments of the present disclosure are disclosed herein, it will be apparent to a person having ordinary skill in the art in view of this disclosure that a variety of changes and/or modifications can be made to the disclosed embodiments without departing from the scope of the present disclosure. Therefore, the scope of the disclosure as well as the scope of the following claims is not limited to embodiments described herein.

The invention claimed is:

1. A heat exchange unit for a heat exchanger, the heat exchange unit comprising:

a plurality of plain fins stacked perpendicularly to a first plane, such that a first fluid is communicable through the first plane between the fins; and a plurality of tubes for communicating a second fluid therethrough for heat exchange with the first fluid, the tubes extending perpendicularly through the fins, each tube comprising an oblique cross-section having a pair of opposing first sides and a pair of opposing second sides, the first sides and second sides being joined to the fins, wherein for each oblique cross-section, the first sides are perpendicular to the first plane and the second sides are angled approximately 60° to the first plane, the first sides being longer than the second sides.

2. The heat exchange unit according to claim 1, wherein each tube comprises an internal rib extending therethrough.

3. The heat exchange unit according to claim 1, wherein the tubes are joined to the fins by brazing.

4. The heat exchange unit according to claim 1, wherein each fin comprises a plurality of collars joining the tubes to the fin.

5. The heat exchange unit according to claim 1, wherein each tube is filleted at edges thereof represented by corners of the oblique cross-section.

6. The heat exchange unit according to claim 1, wherein the tubes are identically oriented relative to the first plane.

7. The heat exchange unit according to claim 1, wherein the tubes are arranged along a single row of each fin and along the first plane.

8. The heat exchange unit according to claim 1, wherein the tubes are formed of an aluminium material.

9. A method for manufacturing a heat exchange unit for a heat exchanger, the method comprising:

forming a plurality of holes in each of a plurality of plain fins;

stacking the fins perpendicularly to a first plane, such that a first fluid is communicable through the first plane between the fins;

forming a plurality of tubes for communicating a second fluid therethrough for heat exchange with the first fluid, each tube comprising an oblique cross-section having a pair of opposing first sides and a pair of opposing second sides, the first sides being longer than the second sides;

inserting the tubes into the holes and perpendicularly through the fins, such that for each oblique cross-section, the first sides are perpendicular to the first plane and the second sides are angled approximately 60° to the first plane; and performing a joining process for joining the tubes to the fins, such that for each oblique cross-section, the first sides and second sides are joined to the fins, thereby forming the heat exchange unit.

10. The method according to claim 9, wherein each tube comprises an internal rib extending therethrough.

11. The method according to claim 9, wherein the joining process comprises a brazing process for brazing the tubes to the fins.

12. The method according to claim 9, wherein said forming of the holes in each fin comprises forming a collar at each hole for joining the tubes to the fin.

13. The method according to claim 9, wherein each tube is filleted at edges thereof represented by corners of the oblique cross-section.

14. The method according to claim 9, wherein the holes in the fins are formed such that the tubes are identically oriented relative to the first plane.

15. The method according to claim 9, wherein the holes are formed along a single row of each fin and along the first plane.

16. A heat exchanger comprising:

an inlet for receiving a second fluid;

an outlet for discharging the second fluid; and a heat exchange unit comprising:

a plurality of plain fins stacked perpendicularly to a first plane, such that a first fluid is communicable through the first plane between the fins; and a plurality of tubes fluidically communicative with the inlet and outlet for communicating the second fluid therethrough for heat exchange with the first fluid, the tubes extending perpendicularly through the fins, each tube comprising an oblique cross-section having a pair of opposing first sides and a pair of opposing second sides, the first sides and second sides being joined to the fins, wherein for each oblique cross-section, the first sides are perpendicular to the first plane and the second sides are angled approximately 60° to the first plane, the first sides being longer than the second sides.

17. The heat exchanger according to claim 16, further comprising a set of headers joined to the tubes and fluidically communicative with the inlet and outlet, each header comprising a set of baffles for distributing the second fluid through the tubes.

18. The heat exchanger according to claim 16, further comprising a plurality of extension elbows for joining the tubes to another plurality of tubes, each extension elbow comprising oblique cross-sectional ends.

19. The heat exchanger according to claim 16, wherein each tube further comprises an internal rib extending therethrough.

20. The heat exchanger according to claim 16, wherein the tubes are formed of an aluminium material.

* * * * *